US006831602B2

(12) United States Patent
McKinzie, III et al.

(10) Patent No.: US 6,831,602 B2
(45) Date of Patent: Dec. 14, 2004

(54) LOW COST TROMBONE LINE BEAMFORMER

(75) Inventors: William E. McKinzie, III, Fulton, MD (US); Greg S. Mendolia, Ellicott City, MD (US); Shelby Starks, Baltimore, MD (US)

(73) Assignee: Etenna Corporation, Laurel, MD (US)

( * ) Notice: Subject to any disclaimer, the term of this patent is extended or adjusted under 35 U.S.C. 154(b) by 0 days.

(21) Appl. No.: 10/152,188

(22) Filed: May 21, 2002

(65) Prior Publication Data

US 2003/0016097 A1 Jan. 23, 2003

Related U.S. Application Data

(63) Continuation-in-part of application No. 09/863,975, filed on May 23, 2001, now Pat. No. 6,590,531.
(60) Provisional application No. 60/370,181, filed on Apr. 5, 2002.

(51) Int. Cl.[7] ..... H01P 1/18
(52) U.S. Cl. ..... 342/375; 333/161
(58) Field of Search ..... 333/161, 156, 333/157, 159; 342/375

(56) References Cited

U.S. PATENT DOCUMENTS

| | | | | |
|---|---|---|---|---|
| 3,916,349 | A | * 10/1975 | Ranghelli et al. | 333/238 X |
| 5,027,127 | A | 6/1991 | Shnitkin et al. | |
| 5,307,033 | A | 4/1994 | Koscica et al. | |
| 5,589,845 | A | 12/1996 | Yandrofski et al. | |
| 5,694,134 | A | 12/1997 | Barnes | |
| 5,757,319 | A | 5/1998 | Loo et al. | |
| 5,874,915 | A | 2/1999 | Lee et al. | |
| 6,097,263 | A | 8/2000 | Mueller et al. | |
| 6,124,827 | A | 9/2000 | Green et al. | |
| 6,198,458 | B1 | 3/2001 | Heinz et al. | |
| 6,246,924 | B1 | 6/2001 | Holdgreve | |
| 6,307,506 | B1 | 10/2001 | Despain | |
| 6,333,712 | B1 | 12/2001 | Haugse et al. | |
| 6,441,700 | B2 | 8/2002 | Xu | |
| 6,512,246 | B1 * | 1/2003 | Tanabe | 333/995 X |

OTHER PUBLICATIONS

Antenna array architecture, R.J. Mailloux, Proceedings of IEEE, vol. 80(1), pp. 163–172, Jan. 1992.
Circulators for Microwave and Millimeter–Wave Integrated Circuits, E.F. Scholemann, Proceedings of the IEEE, vol. 76(2), pp. 188–200, Feb. 1988.
Applications of Antenna Arrays to Mobile Communications. I. Performance Improvement, Feasibility, and System Considerations, L.C.Gordara, Proceedings of the IEEE, vol. 85(7), pp. 1031–1060, Jul. 1997.
Application of Antenna Arrays to Mobile Communications, II. Beam–Forming and Direction–of–Arrival Considerations, L.C. Godara, Proceedings of the IEEE, Vo. 85(8), pp. 1195–1245, Aug. 1997.
Patent application Ser. No. 09/839,323, filed Apr. 20, 2001, entitled "Variable Time–Delay Microwave Transmission Line."
Antenna array architecture, R.J. Mailloux, Proceedings of IEEE, vol. 80(1), pp. 163–172, Jan. 1992.

* cited by examiner

*Primary Examiner*—Benny Lee
(74) *Attorney, Agent, or Firm*—Brinks Hofer Gilson & Lione

(57) ABSTRACT

A microstrip trombone delay line is used to provide a low cost true time delay device. An array of printed trombone lines arranged in a network is used to implement a linear beamformer. The beamformer forms an array that scans signals in one or more dimensions. Each microstrip trombone delay line includes printed traces on a fixed substrate and a printed trombone line on a movable superstrate. The microstrip trombone delay line may have different dimensions to vary the characteristic impendence at either end for impedance matching purposes. Beamformers using microstrip trombone delay lines and scanning in multiple principal planes require few movable parts and only linear actuators.

74 Claims, 21 Drawing Sheets

100
102
Minimum Delay
104
In
Out

+x
102
Maximum Delay
104
In
Out

Example:

Zo1 = 60Ω L1 = 20mm
Zo2 = 74Ω L2 = 35mm nominal
Zo3 = 85Ω L3 = 35mm nominal
Zo4 = 92Ω L4 = 20mm

LOW COST TROMBONE LINE BEAMFORMER

RELATED APPLICATIONS

This application is a utility application based on U.S. Provisional Patent Application Ser. No. 60/370,181, filed Apr. 5, 2002 in the names of William E. McKinzie, III, Greg S. Mendolia, and Shelby Starks and entitled "A Low Cost Trombone Line Beamformer," based on a continuation-in-part of U.S. patent application Ser. No. 09/863,975, filed May 23, 2001 in the names of William E. McKinzie, III and James D. Lilly and entitled "Planar, Fractal, Time-Delay Beamformer," now U.S. Pat. No. 6,590,531, issued Jul. 8, 2003 herein incorporated in their entirety.

BACKGROUND

This invention relates to antennas and devices incorporating antennas. In particular, this invention relates to low cost passive, true time delay beamformers that can be used to feed an antenna array.

Like other electronic components and systems, the speed, complexity, and component density in microwave and millimeter-wave systems have been ever-increasing. With the increasing number and variety of components, controllers, and connections, the power consumption and noise and other interference problems of these systems have correspondingly increased. One and two dimensional electronically scanned arrays, i.e. beamformers, are integral components of these systems. The beamformer uses a limited number of control signals to control multiple time delay components (phase shifters) distributed into a fractal RF feed network and thereby scan the main beam of the beamformer.

Conventional phase shifters use relatively bulky, expensive perturbers that are external to the actual phase shifters (the substrate containing the feed network or the antenna array) to modify the electrical characteristics of transmission lines in the phase shifters. Needless to say, conventional phase shifters are in general difficult and expensive to fabricate. Conventional phase shifters are also generally RF-active devices that require a comparatively large amount of power and may interfere with the transmitted signal. In addition, because conventional phase shifters alter the phase of an input signal thereby only simulating a time delay, a fixed, progressive time delay between elements is obtained only over a relatively narrow band of frequencies. As a consequence, if the frequency of the beam wanders, the pointing angle wanders correspondingly.

Thus, a beamformer that employs conventional phase shifters only forms a beam at essentially one frequency or a narrow band of frequencies; if the frequency transmitted changes substantially, the antenna element spacing must be either physically moved or the phases set by the phase controllers changed to form a beam at the new frequency (in a controllable-type beamformer array). This process may be time consuming and awkward or even physically impossible. Further, this is increasingly important for systems communicating at frequencies that are relatively far apart. Some existing and proposed earth-orbiting satellite communication systems communicate simultaneously at approximately 20 and 30 GHz.

Accordingly, variable true time delay devices, as well as beamformers that employ the variable true time delay devices, are desirable: they have low power consumption, decreased interference, are low-cost, and have a given pointing angle over a broad band of frequencies.

SUMMARY OF THE INVENTION

To provide these and other objects presented herein, the variable true time delay device comprises a fixed medium having a first conductive path along which electromagnetic signals propagate, a movable medium having a second conductive path along which the signals propagate, and, in some cases, a thin dielectric layer disposed between the fixed and movable media. The movable medium is translatable such that the second conductive path overlaps the first conductive path by a variable amount. The time delay through the device is dependent on the overlap between the first and second conductive paths.

The first and second conductive paths may be printed traces such as used in microstrip, stripline, or coplanar waveguide transmission lines. The movable medium may be linearly translatable by an actuator. Either or both of the first and second conductive paths may comprise a U-shaped path which we denote as a trombone line.

The first conductive path may comprise four sections of different widths in which pairs of the sections symmetric around a center line have the same length. Similarly, the second conductive path may comprise sections having the same length, symmetric around the center line, and overlapping one pair of the four sections. The lengths and widths of the sections of the first and second conductive paths may be selected to implement an impedance match between ends of the first conductive paths.

In some embodiments, no direct or ohmic contact is required between the first (fixed) and second (movable) conductive paths. The movable medium may have dielectric materials whose permittivity is much lower than that of the fixed medium, and comprise a sliding stop to prevent overrun of the first conductive path by the second conductive path.

Beamformers may use any of the above phase shifters. The beamformer may, for small scan angles, have a scan angle defined by:

$$\theta = \arcsin\left(\frac{4\Delta}{d}\sqrt{\varepsilon_{eff}}\right)$$

where $\Delta$ is the physical displacement of the second conductive path, d is an inter-element spacing between antenna elements of the beamformer, and $\epsilon_{eff}$ is an effective dielectric constant of a feed network of the beamformer.

The beamformer may require only one actuator per dimension of beam forming.

DETAILED DESCRIPTION OF PREFERRED EMBODIMENTS

The different embodiments below are directed towards fabrication of a low cost, passive, true time delay (TTD) beamformer and components that can be used to feed an antenna array. The embodiments illustrate individual delay lines and combinations of delay lines that are mechanically actuated to form TTD beamformers. The TTD beamformers can be used to form one and two dimensional scanned planar phased arrays that have a much lower cost and other benefits such as decreased insertion loss, reduced power consumption and stable beam pointing direction over a wide range of frequencies.

Conventional solutions for phased array antennas include arrays of electronic transmit/receive (T/R) modules, each feeding a dedicated antenna element. Such an array may typically cost hundreds to thousands of dollars per module, depending on electrical specifications, for materials alone, not including research and development, non-recurring engineering, and the cost of the antenna array. In addition, arrays that contain conventional T/R modules require prime power, and are generally not as broadband as arrays disclosed herein. The embodiments shown in this application do not require prime power when dormant (i.e. when not scanning), and require minimal power during beam scanning.

Figures 1A, 1B:
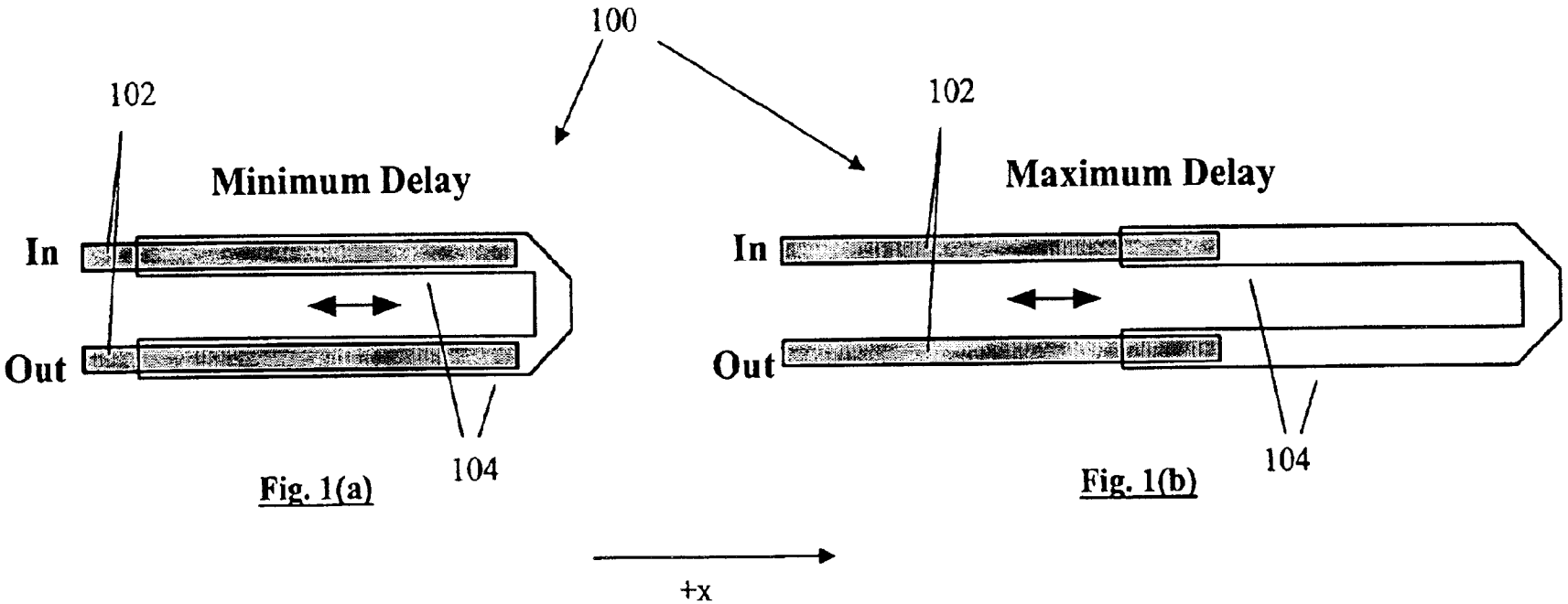
FIGS. 1*a* and 1*b* show a single printed trombone delay line according to an embodiment.

The fundamental concept for a true time delay device is the microstrip trombone delay line 100 shown in FIGS. 1*a* and 1*b*. In these explanatory figures, two parallel microstrip lines 102 are printed on a fixed substrate (not shown). Another U-shaped microstrip line (the trombone line) 104 is printed on a second moveable superstrate (not shown). Here, the trombone line 104 is defined to be only the portion of the entire transmission line that is movable (or translatable). Electromagnetic signals propagate along the conductive paths, i.e. the parallel and U-shaped microstrip lines. The microstrip lines are typically conductive traces that have been printed on the material accommodating the particular microstrip line using conventional fabrication techniques.

Previously, fixed and translatable microstrip lines required direct or ohmic contact. This is often times difficult to achieve uniformly over both the length of the overlapping printed conductors and over time. In one embodiment, a thin dielectric layer (membrane) is disposed between the fixed and translated conductors, such that significant capacitive coupling exists between overlapping microstrip lines. This dielectric layer may be any layer having a permittivity larger than that of a layer of air. In other embodiments, the dielectric layer may not be present.

The combination of the parallel microstrip lines 102 (which are types of coplanar waveguides and the trombone line 104 form a variable delay line (VDL) that delays electromagnetic signals entering (In) one end of one of the parallel microstrip lines 102 and exiting (Out) from the end of the other of the parallel microstrip lines 102. As the trombone line 104 is physically translated in the +x direction (to the right in FIGS. 1*a* and 1*b*), the time delay increases because the physical length of the microstrip lines 102 and 104 increases. The minimum time delay of the microstrip trombone delay line 100 thus occurs with minimal extension of the trombone line where maximal overlap exists of the parallel microstrip lines 102 and the trombone line 104. This is to say that substantially all of the parallel sections 102 overlap with the trombone line 104, as shown in FIG. 1*a*. Correspondingly, the maximum time delay occurs with maximum extension of the trombone line 104 with minimal overlap, i.e. substantially little of the parallel sections 102 overlap with the trombone line 104, as shown in FIG. 1*b*. In the embodiment shown, the parallel microstrip lines 102 are of the same width, the legs of the trombones line 104 are of the same width, and the trombone lines 104 are slightly longer and about the same width as the parallel microstrip lines 102. As shown, the microstrip trombone delay line 100 is symmetric about a center line around the width of the microstrip trombone delay line 100. In the embodiment illustrated in FIGS. 4*a* and 1*b*, the line widths are all equal so as to obtain a uniform microstrip characteristic impedance. The microstrip lines 102 and 104 and the trombone line 104 can either continuously variably overlap, i.e. the increase in overlap is linear, or incrementally variably overlap.

Figure 2A:
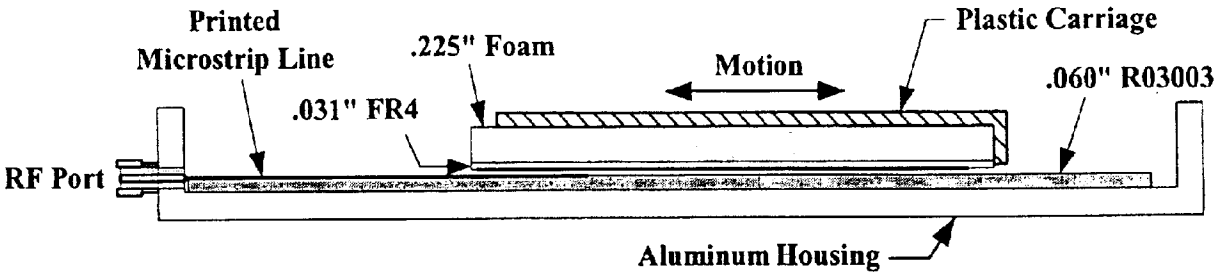
FIGS. 2*a*, 2*b*, and 2*c* show a prototype trombone delay line implemented in microstripline.
Figure 2C:
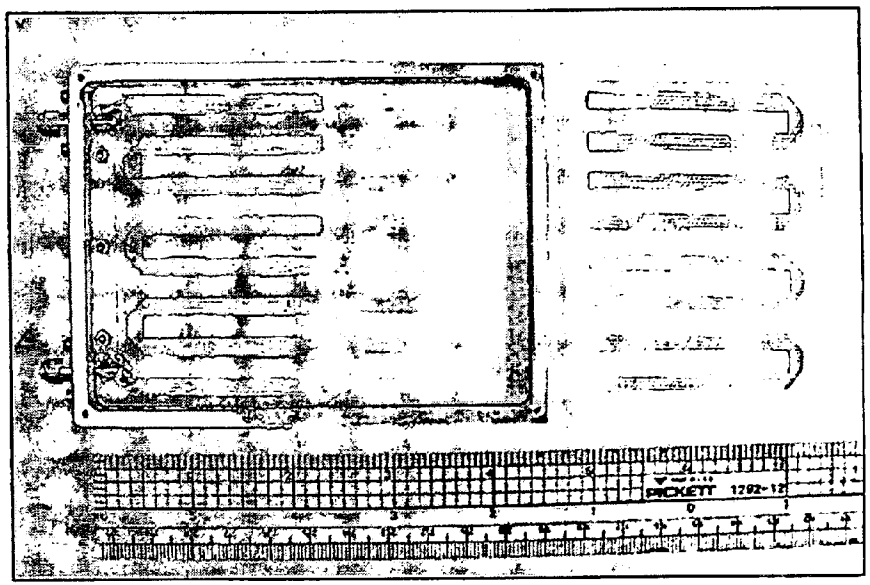
Figure 2B:
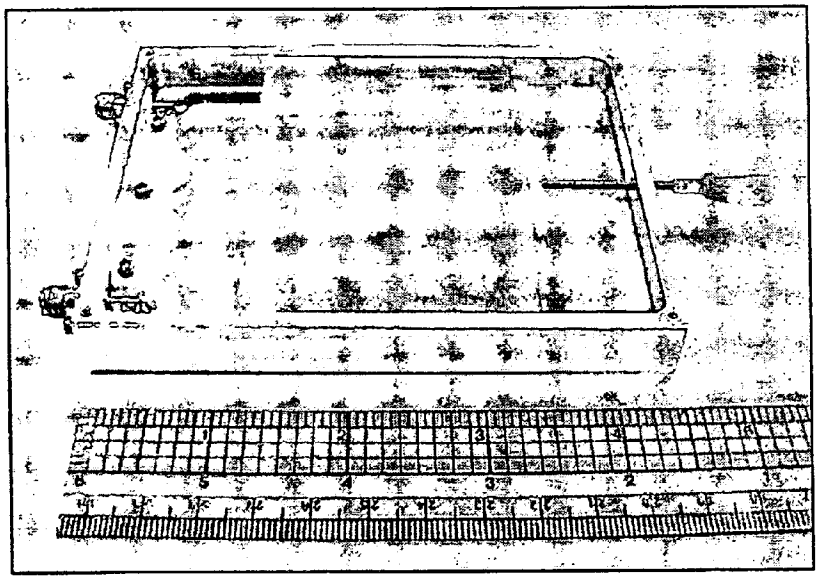

A prototype variable delay line is shown in FIGS. 2*a*, 2*b*, and 2*c*. In this prototype, the delay line contains four trombone lines, cascaded in series, implemented with a nominal 50Ω microstrip line. RF ports are disposed at the end of each of the fixed parallel microstrip lines. Three fixed, U-shaped microstrip lines are disposed on the fixed substrate between the parallel microstrip lines connected with the RF ports. Each of the four moving trombone lines overlap one of three fixed U-shaped microstriplines and either another of the three fixed U-shaped microstriplines (thereby linking the three fixed U-shaped microstriplines in cascade) or one of the parallel microstrip lines (thereby linking the three fixed U-shaped microstriplines to the input RF port and output RF port).

The fixed substrate is formed from 0.061" Rogers R03003 and is disposed on an aluminum (or other metallic) housing.

The metallic housing helps to shield the microstrip lines from external electromagnetic signals that may cause interference. The movable superstrate is 0.031" thick FR4. The movable superstrate is attached to a backing material such as foam, which is in turn attached to a plastic carriage, thereby forming a superstrate assembly. Translation of the superstrate assembly is achieved via a manually adjusted set screw (or other mechanical linear actuator), that varies the position of the superstrate assembly. The total insertion delay varies from about 2.6 nsec to about 4.5 nsec at 1.75 GHz for a total travel distance of 1.5". The insertion loss is nominally 0.8 dB at 1.75 GHz while the return loss is less than −20 dB. Note that the design shown has not been optimized for the TTD device: insertion loss and return loss can be improved with changes in microstrip layout and dielectric materials.

One feature of embodiments shown herein is that the movable superstrate containing the trombone lines has a permittivity much lower than that of the fixed substrate containing the parallel lines. The movable superstrate, in fact, has as low a permittivity as possible to decrease the perturbation on the electric fields of the microstrip lines (either the fixed or moving lines). One manner to achieve this is to form the movable superstrate as thin as practically possible. For example, the prototype was only about 10 mils thick. For the same reason, the per unit length parallel plate capacitance that occurs due to the overlap between the fixed and movable microstrip lines dominates the fixed capacitance per unit length inherent in the fixed microstrip lines.

Figure 3:
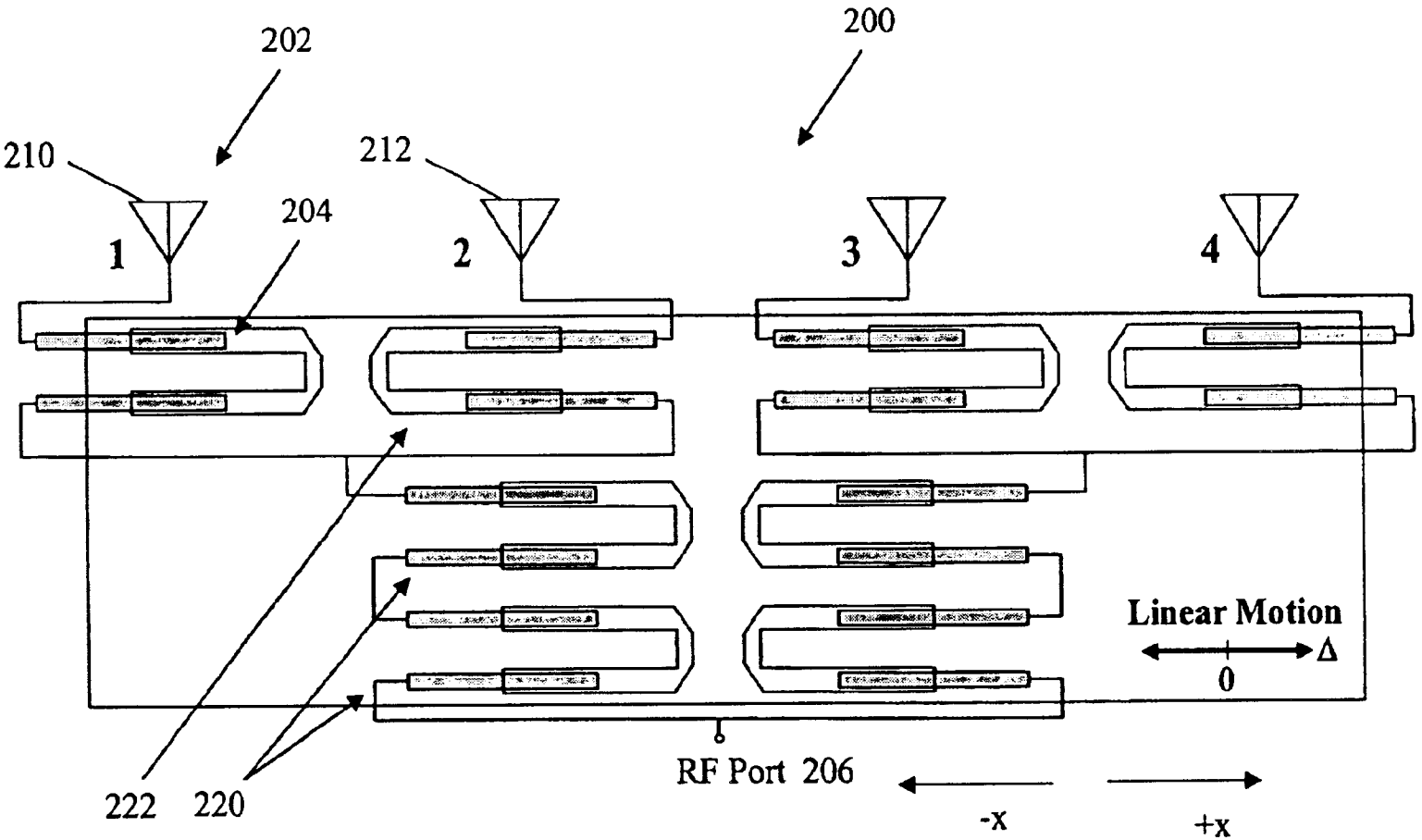
FIG. 3 shows a TTD Beamformer with four output ports for one dimensional Scanning according to one embodiment.

FIG. 3 shows a one dimensional scanned array 200 with four antenna elements 202. This is to say that the array is scanned in one principal plane direction. The beamformer 200 employs eight identical trombone delay lines 204 that are all attached to the same superstrate (not shown) and thus integrated into a corporate feed network. In one example, the trombone delay lines 204 are printed on the superstrate and are translatable in unison. In the example shown, movement is restricted to be only in the horizontal direction (±x direction).

Each delay line 204 is part of the corporate feed network 200. A nominal position of the superstrate, as shown in FIG. 3, is such that the about ½ of the parallel microstrip lines and trombone line that form each trombone delay line 204 overlap. In the nominal position, the time delay is equal for all elements and a broadside beam is formed. This is to say that the path length from the RF port 206 to each antenna element 202 is equal.

When the superstrate is translated in the +x direction (to the right in the figure), the attached trombone lines are translated toward the right by the same amount. Assuming a physical displacement of Δ, the propagation delay to the first element 210 is increased by $3(2\Delta)/v_p$ where $v_p$ is the phase velocity of the dominant mode on the microstrip line. This is to say that each microstrip line has a relative delay of $\Delta/v_p$, there are two microstrip lines in each trombone delay line (so each trombone delay line has a delay of $2\Delta/v_p$), and there are three trombone delay lines positioned in the same direction (and thus the time delay changes in the same manner) between the RF port 206 and the first element 210. The propagation delay to the second element 212 is increased by a lesser amount, only $2\Delta/v_p$ as two of the trombone lines are positioned in one direction and the third trombone line is positioned in the opposite direction. Thus, in this example, the time delay of two of the trombone delay lines 220 each increase by the same amount (total time delay=$2(2\Delta)/v_p$) while the time delay of the other trombone delay line 222 deceases by that amount (time delay=$-2\Delta/v_p$), thereby canceling the overall time delay of one of the two trombone delay lines 220. Thus, the progressive time delay between adjacent elements is $4\Delta/v_p$. As can be seen, elements on the left side of FIG. 3 will experience a greater time delay than the nominal time delay, and elements on the right side of FIG. 3 will experience a shorter time delay than the nominal time delay. The net result is that the main beam of the beamformer 200 will scan in the −x direction.

Figure 15:
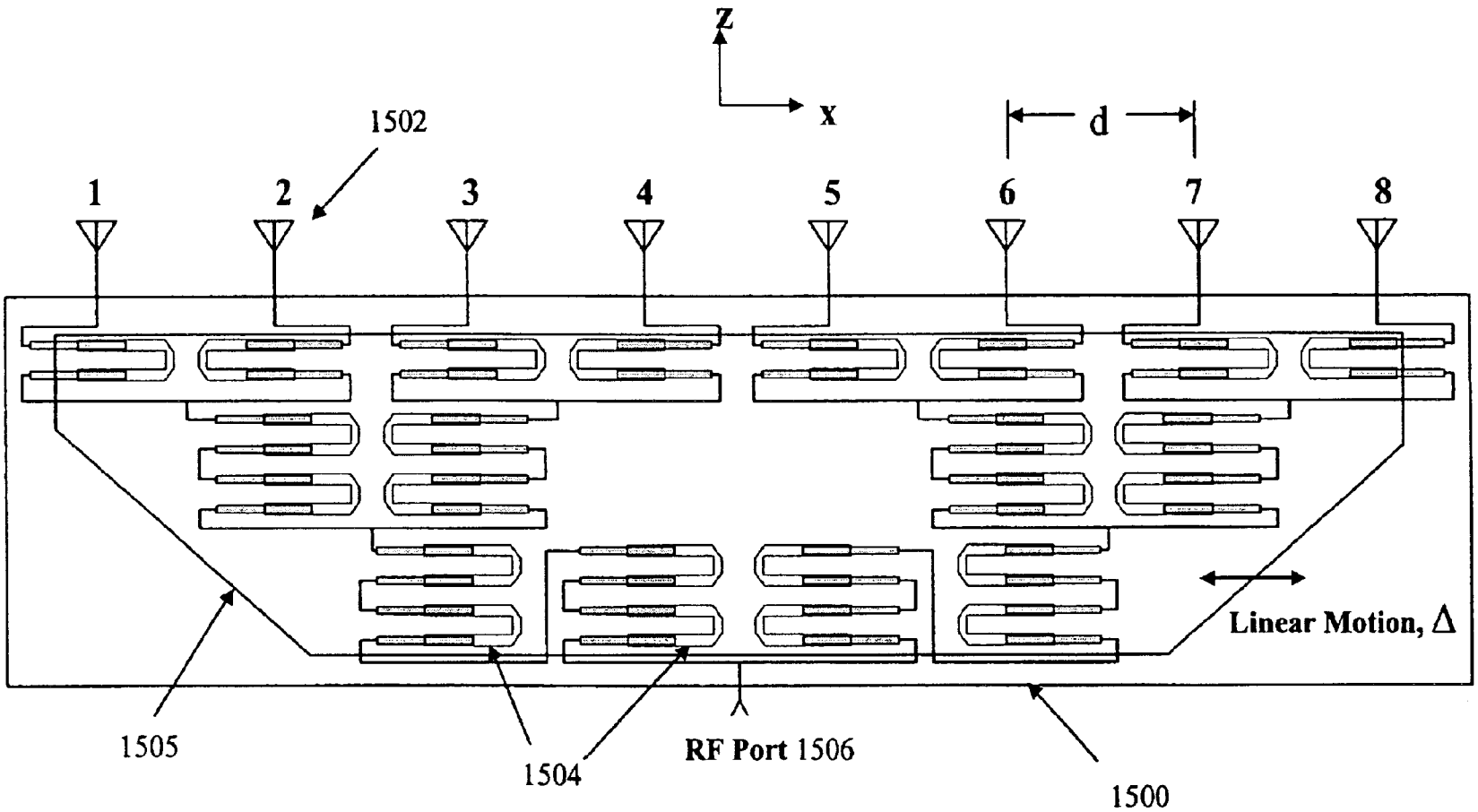
FIG. 15 shows a TTD beamformer with eight output ports for one dimensional Scanning according to one embodiment.

Of course, the number of trombone lines embedded in a corporate array can be increased to feed any number of elements (e.g. 8 elements, 16 elements) with the addition of more trombone lines near the RF feed port. Despite the additional trombone lines, the pattern of the corporate feed structure remains quite simple. An example of an eight-element trombone line beamformer 1500 is illustrated in FIG. 15. Trombone lines 1504 are uniform in size and printed on a common superstrate 1505 such that they are translated in unison. As with the four-element array, the progressive time delay between adjacent elements is $4\Delta/v_p$.

The mathematical model for beam scanning as a function of the physical displacement of the superstrate is provided below. These equations are appropriate for the one dimensional beamformer shown in FIG. 3. Given an M element, uniformly spaced, linear array distributed along the x axis with inter-element distance d, the array factor is given by:

$$A(\theta) = \sum_{m=1}^{M} I_m e^{jm(k_0 d \sin(\theta) - \alpha_x)}$$

where the progressive phase shift per element in the +x direction is $\alpha_x$. Assuming that the excitations are restricted to be real, and defined by $I_m$, then the main beam is defined by $k_0 d \sin(\theta)=\alpha_x$. Hence the beam scan angle from broadside is given by:

$$\theta = \arcsin\left(\frac{\alpha_x}{2\pi}\frac{\lambda}{d}\right)$$

The inter-element time delay, or progressive time delay, of $t_d=4\Delta/v_p$ can also be expressed as $t_d=\alpha_x/\omega$. Hence $\alpha_x=2\pi f(4\Delta/v_p)$. Therefore the beam scan angle from broadside can be expressed as:

$$\theta = \arcsin\left(\frac{4\Delta}{2\pi v_p}2\pi f\frac{\lambda}{d}\right) = \arcsin\left(\frac{4\Delta}{d}\frac{c}{v_p}\right) = \arcsin\left(\frac{4\Delta}{d}\sqrt{\varepsilon_{eff}}\right)$$

where d is the inter-element spacing and $\epsilon_{eff}$ is the effective dielectric constant of the feed network. Note that one assumption is that the microstrip line phase velocity, $v_p$, is constant throughout the feed network, even though the microstrip line width (characteristic impedance) changes in every branch. This is a reasonable assumption as indicated in published curves of $\epsilon_{eff}$, which are relatively flat as a function of line width. (See, for example, FIG. 1.16 from Chapter 1 of *Handbook of Microwave and Optical Components Volume* 1, edited by Kia Chang.)

Figure 4B:
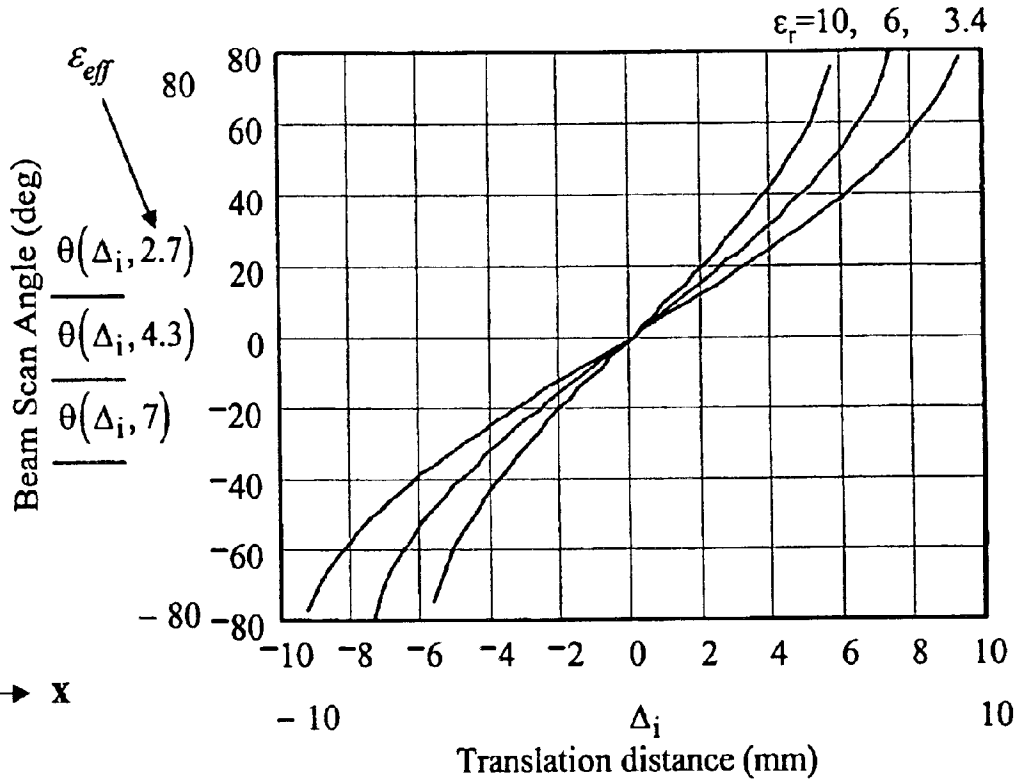
FIGS. 4*a* and 4*b* show a schematic view of a linear array and a plot of beam scan angle from broadside for a 2.4 GHz array according to one embodiment.
Figure 4A:
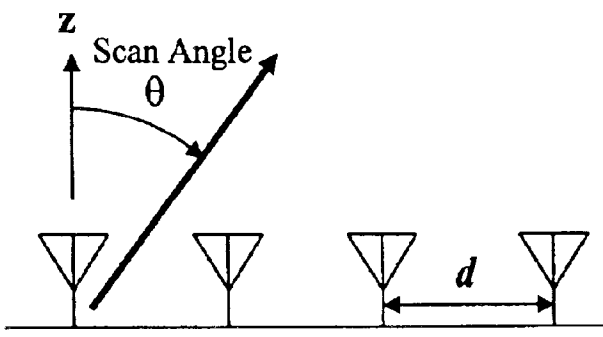

FIGS. 4*a* and 4*b* show a schematic view of a linear array and a plot of the scan angle for a 2.4 GHz linear array with half wavelength spacing for three different effective dielectric constants according to the above equations. In the plot, f=2.4 GHz, d=λ/2, and the microstrip substrate is R04003 ($\epsilon_r$=3.38, and $\epsilon_{eff}$~2.7). A nominal overall length of 30 mm is chosen for the trombone delay lines for an inter-element spacing d of 62.5 mm (about 2.46"). This implies that half of the unwrapped trombone line length is about 35 mm. Assuming that the nominal overlap between the fixed and translated portions of the trombone line is 10 mm, then the maximum translation distance is about 8 mm to 10 mm either side of nominal. Hence the range of physical lengths available is about 25 mm to 45 mm for half of the trombone line length. As shown in FIG. 4*b*, a scan angle of ±60° is easily achieved for superstrate translations of about ±8 mm or less.

Figure 5B:
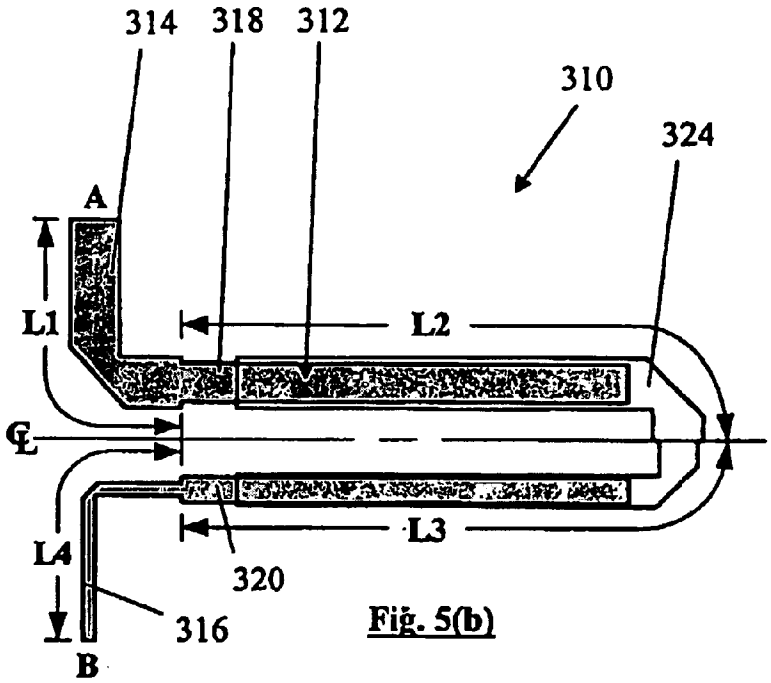
FIGS. 5*a*, 5*b*, and 5*c* show a corporate feed network, embedded trombone delay lines, and an electrical equivalent circuit to one of the trombone delay lines according to a second embodiment.
Figure 5A:
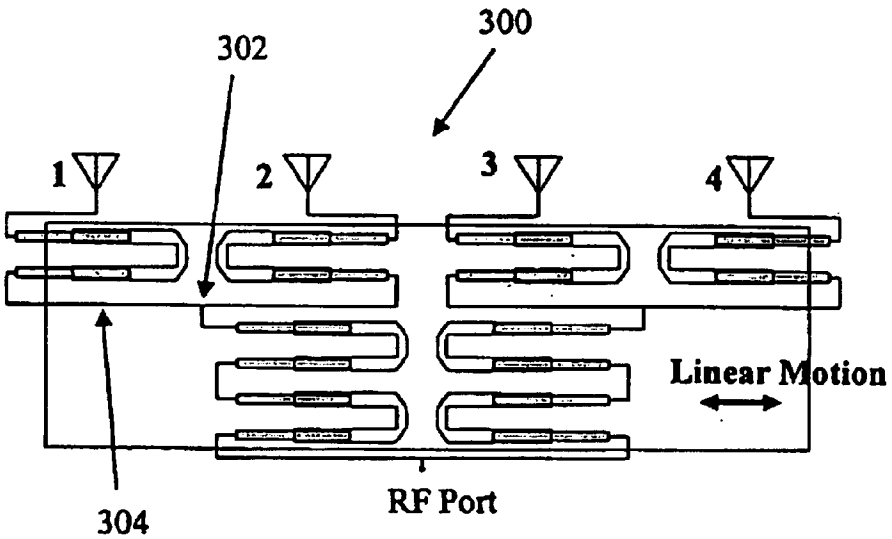
Figure 5C:
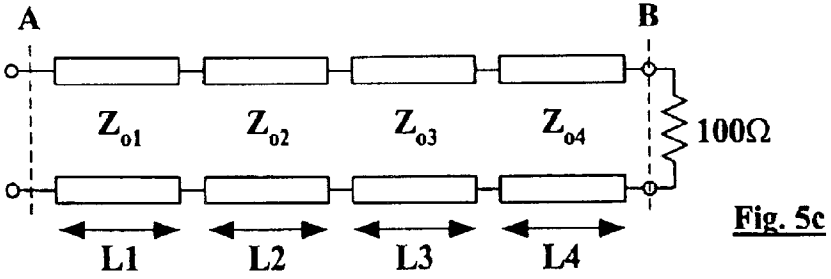

FIGS. 5*a*, 5*b* and 5*c* show a corporate network 300, trombone delay lines 310, and an equivalent circuit 330 to one of the trombone delay lines 310 according to a second embodiment. In this embodiment, a 2:1 impedance matching function is integrated into the trombone delay line 310 as four cascaded transmission lines 312 of monotonically arranged characteristic impedances. One of the challenges in the design of a corporate feed network 300 is to impedance match the feedline 304 between T junctions 302. One wax to achieve this is using a ratio of 2:1 in characteristic impedance, for example 50Ω to 50Ω which may be created by fabricating the trombone delay line 310 with different characteristic impedances on opposite sides of the centerline CL. In essence, this circuit may really be described as four cascaded transmission lines 312 in which the outer two lines 314, 316 are fixed in length and the inner two fines 318, 320 are variable In length. The outer two lines 314, 316 and inner two lines 318, 320 all have different widths and are paired to have equal lengths (L1=L4, L2=L3). The lengths of the outer two lines 314, 316 and inner two lines 318, 320 may or may not be equal (i.e. L1 may=L2). Each of the movable microstriplines 324 of the trombone delay line 310 is similar in width to the corresponding inner two microstriplines 318, 320, thus covering the section of the corresponding inner line when overlapping with it.

In one example, point B is a T junction 302 in which the trombone delay line 310 provides a resistive load of 100 Ω. The goal is to transform a 50Ω real impedance at point A to a 100Ω real impedance at point B. The degree of success is quantified by calculating the return loss at point A with a 100Ω load at point B for various translation distances of the trombone line 324. In this 100Ω to 50Ω example, one design of the equivalent circuit 330 of the four-stage impedance matching trombone line 310 has $Z_{o1}$=60 Ω, $Z_{o2}$=74 Ω, $Z_{o3}$=85Ω and $Z_{o4}$=92Ω where $Z_o$ is the characteristic impedance of the corresponding transmission line 312. These impedances correspond to electrical lengths of the individual transmission lines of L1=L4=20 mm and L2=L3=35 mm (when in the nominal position).

Figure 6A:
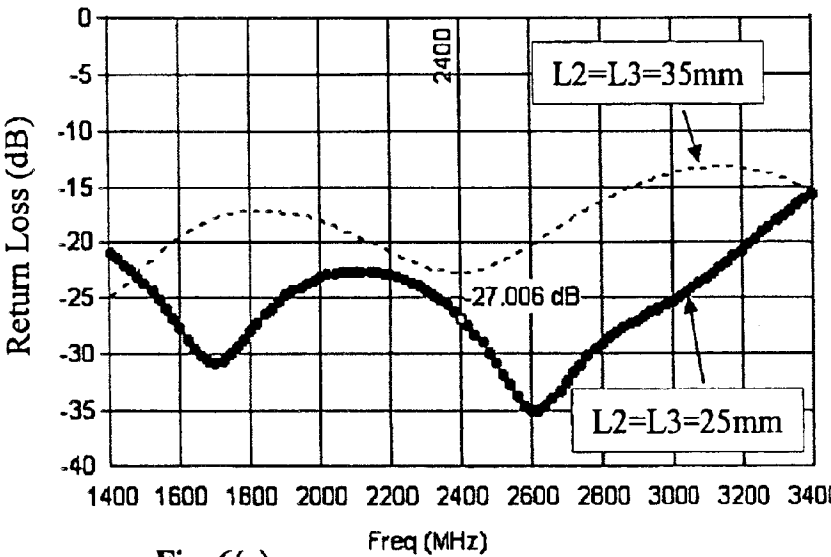
FIGS. 6*a* and 6*b* shows a plot of the return loss at reference plane A according to one example of the second embodiment.
Figure 6B:
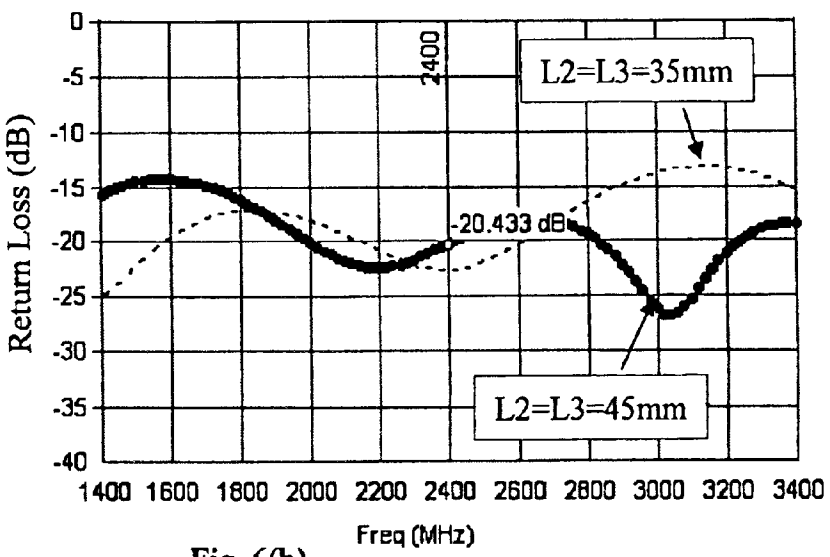

Return loss at reference plane A of this example is plotted in FIGS. 6*a* and 6*b* relative to a 50Ω characteristic impedance. The network is assumed to be lossless, and the effective dielectric constant is assumed to be 2.7 for each transmission line, a reasonable approximation for a microstrip line on a Rogers R04003 substrate. The simulation is done using Eagleware's linear circuit simulator. The resulting return loss in this circuit is better than −20 dB for a wide range of trombone lengths (both for the nominal trombone length of 35 mm as well as for values of 25 mm and 45 mm), far in excess of what would be needed in a system operating at a frequency of 2.4 GHz. Without any attempt at impedance matching, the return loss is −10 dB. Circuit simulations show that |S11| is less than −20 dB for all values of L2=L3 from 5 mm to 100 mm, although only a fraction of this range is physically realizable in any given trombone design. These plots thus demonstrate that the impedance matching function is effective. Furthermore, the design values shown are of an initial design, and are not in any way optimized.

Figure 7:
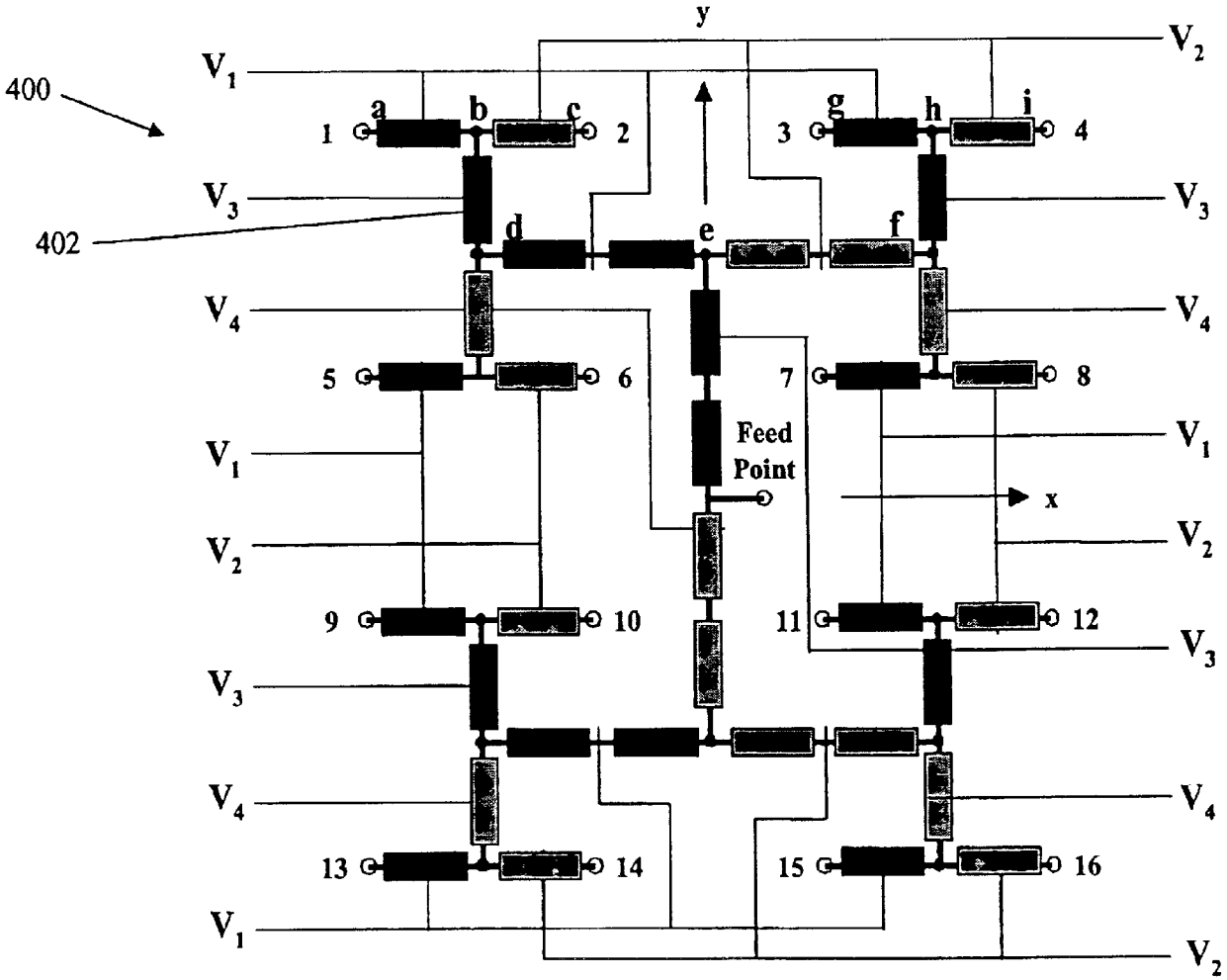
FIG. 7 illustrates a planar, fractal, beamformer architecture for 2D beam scanning.

FIG. 7 illustrates an embodiment of a two dimensional beamformer using a planar fractal beamformer architecture for a 16 element corporate feed array 400. This beamformer 400 is more fully described in the aforementioned pending application entitled "Planar Fractal Time Delay Beamformer." Briefly, in the beamformer the true time delay (TTD) devices 402 are integrated into a microstrip corporate feed network 400, as shown by the blocks. Each TTD device 402 has an insertion delay which is linearly related to an applied control voltage. As shown in the figure, four unique control voltages ($V_1$, $V_2$, $V_3$, $V_4$) are all that is required to obtain 2D beam scanning of the beamformer 400 (i.e. beam scanning in two principal plane directions). The beamformer 400 may be either electrically actuated, as shown in the figure, or mechanically actuated. In one embodiment, shown in FIG. 8, trombone delay lines are inserted into the corporate feed network 400 at the locations identified for TTD devices 402. By using trombone delay lines, decreased costs as well as lower power consumption and broadband operation are provided.

Figure 8:
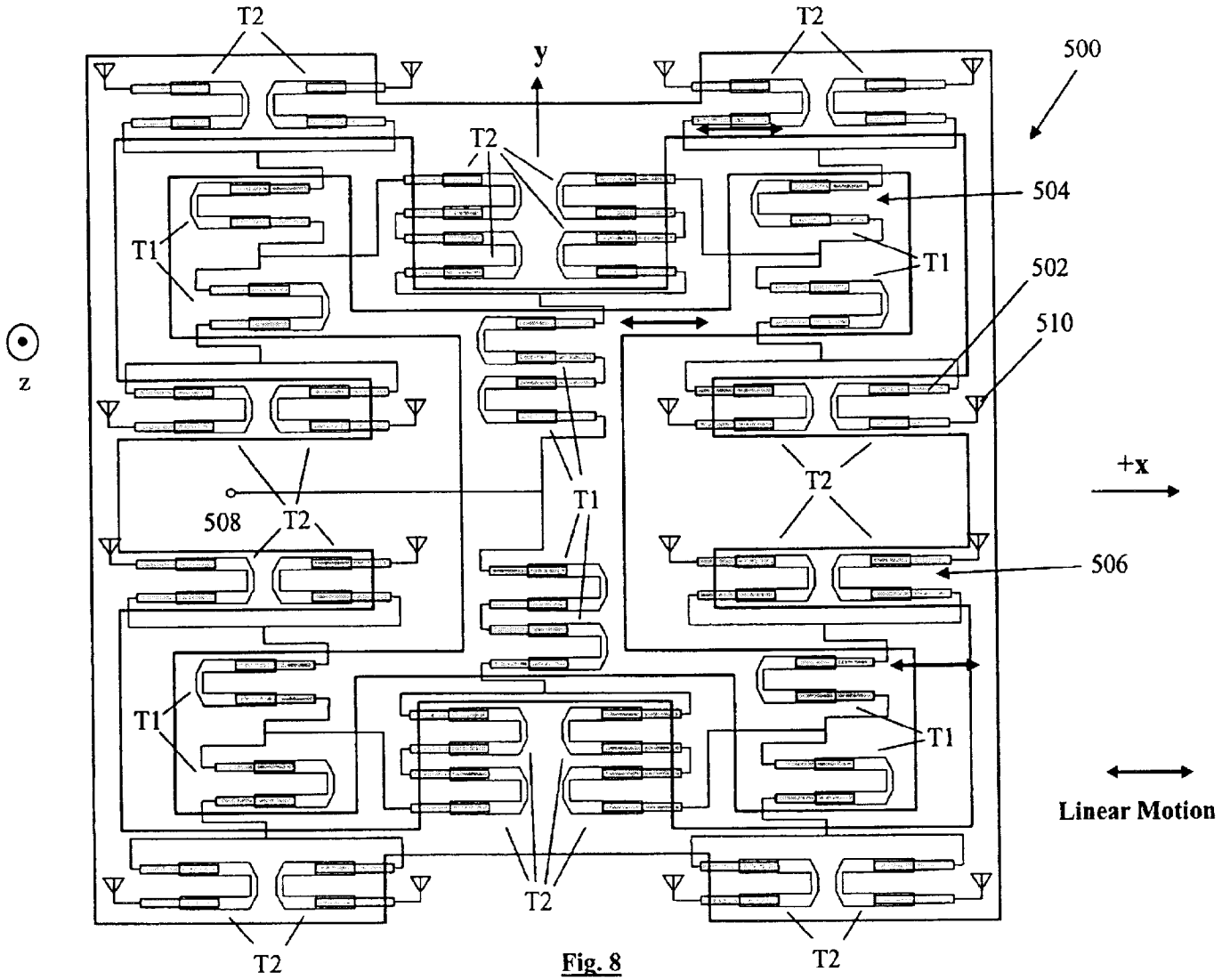
FIG. 8 illustrates a planar, fractal, beamformer incorporating trombone lines according to one embodiment.

FIG. 8 illustrates a 2D scanning beamformer 500 containing a 4×4 (16) element array. An input signal is supplied to the RF feed (input port) 508 and is transmitted from the output ports 510 as a 2D scanned output signal. As in the other embodiments, the substrate contains the fixed transmission lines 502. A first superstrate contains 12 identical length trombone lines 504 labeled as T1), which move in unison to affect beam scanning in the yz plane. A second superstrate contains 24 identical length trombone lines 506 (labeled as T1), which move in unison to affect beam scanning in the xz plane. As above, the time delay through trombone delay lines will change by translating either superstrate in the ±x direction. Each superstrate is independently actuated by different mechanisms. In the example shown, linear motion of each superstrate is restricted to the ±x direction. Thus, only two moving parts, the red and blue superstrates, are used in the RF circuit. The beamformer feed network 500 here contains symmetrical line lengths, and each trombone delay line is identical, thereby creating a uniform and progressive time delay across rows and columns of the beamformer output ports 510. A low cost phased array may be fabricated by using trombone lines in this 2D beamformer because 1) there are no RF electronic components, 2) the beamformer is fabricated with printed circuit technology, and 3) there are only 2 moving parts.

Figure 9:
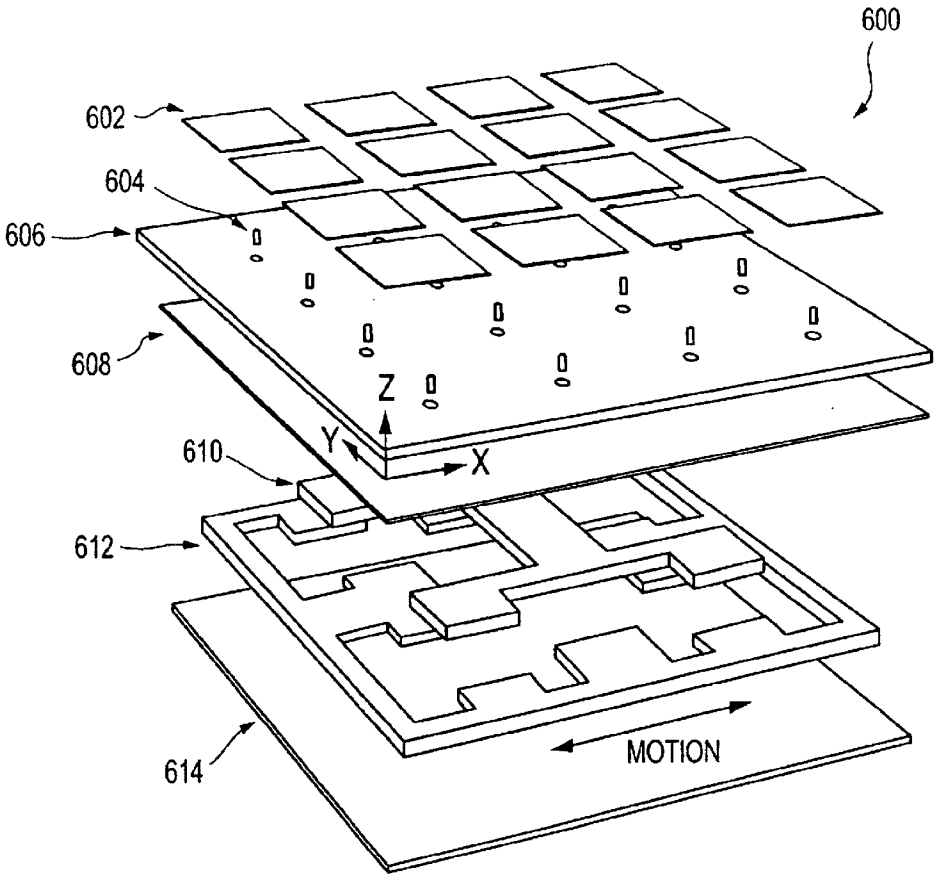
FIG. 9 shows an exploded view of a 16 element, 2D scanned phased array concept in one embodiment, which employs the architecture shown in FIG. 8.
Figure 11:
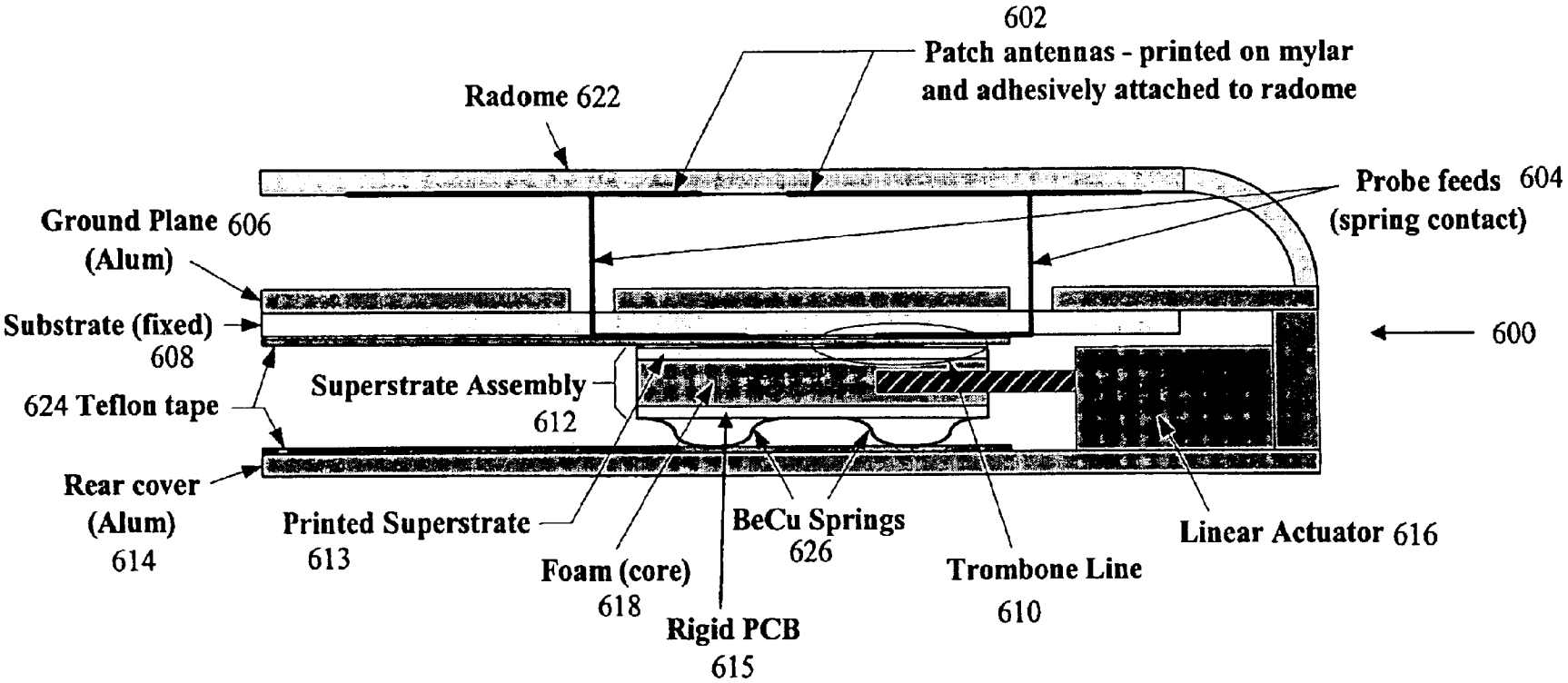
FIG. 11 is a partial illustration of a sectional view of the array shown in FIG. 9.

FIG. 9 shows an exploded view of a 16 element, 2D scanned, 2.4 GHz phased array 600. As shown, the phased array 600 is a multi-layer structure. An array of capacitive patches 602 is printed directly on an upper layer (not shown) or, as shown in FIG. 11, printed on Mylare® and adhesively attached to the underside of a radome cover 622. The capacitive patches 602 are separated from a ground plane 606 through a solid dielectric layer or air. Each of the capacitive patches 602 are connected to the outputs of the beamformer substrate 608 through a conductive probe feed 604. The conductive probe feed 604 may be formed from separate pins, stamped metal posts, deposited vias (in the dielectric layer between the capacitive patches 602 and the ground plane 606), spring contacts, or any other mechanism suitable to establish electrical contact between the capacitive patches 602 and the ground plane 606. The capacitive patches 602, conductive probe feed 604 and ground plane 606 are all formed of any conductive material, and typically a metal such as copper, copper-beryllium or aluminum.

Figure 10A:
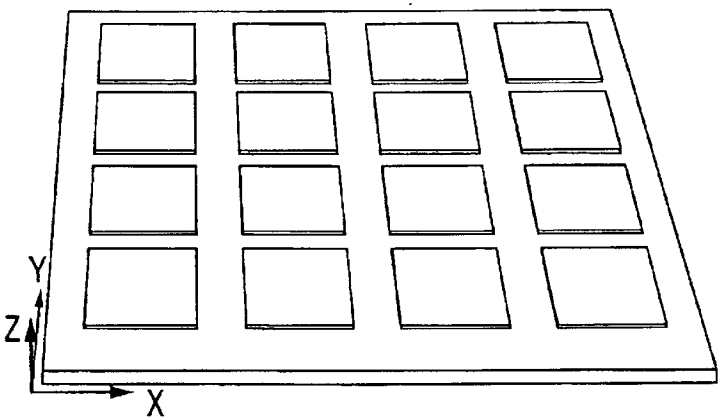
FIGS. 10*a*, 10*b*, and 10*c* show top, side, and bottom views of the scanned phased array concept of FIG. 9.
Figure 10B:
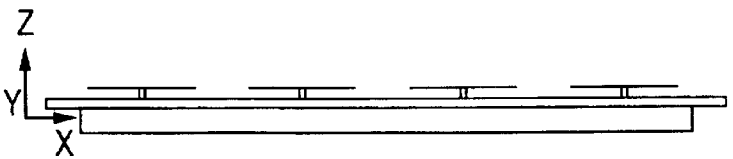
Figure 10C:
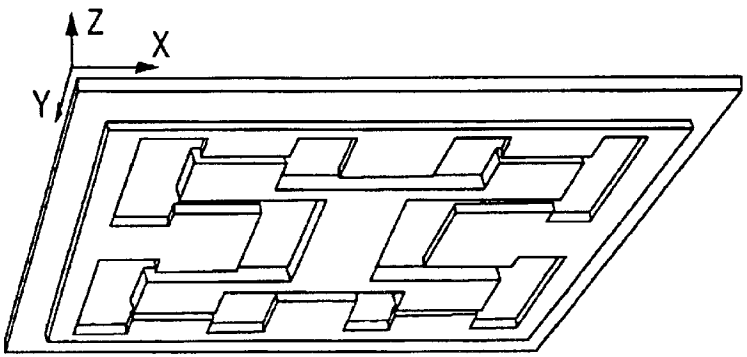

The capacitive patches 602, conductive probe feed 604, and ground plane 606 structure is disposed on a beamformer substrate 608 formed of a printed microwave quality substrate, for instance. The ground plane 606 is attached to the substrate 608. An inner (first) superstrate assembly 610 and outer (second) superstrate assembly 612 are disposed under the substrate 608. The inner and outer superstrate assemblies 610, 612 are also formed of a printed substrate, for example, and contain the trombone lines described above. A conductive rear cover 614 formed of similar materials as the above conductive elements is disposed on the outer superstrate assembly 612. Thin layers of a lubricating dielectric material may be disposed between the superstrate assemblies 610 and 612, and the beamformer substrate 608, or between the superstrate assemblies 610 and 612 and the conductive rear cover 614. The inner and outer superstrate assemblies 610, 612 are movable by two independent linear actuators (one for each superstrate) while the other layers mentioned above are fixed. Note that the inner and outer superstrate assemblies 610 and 612 are translated along the same axis, the x axis in FIG. 8. FIGS. 10*a*, 10*b* and 10*c* show top, elevation, and bottom views of the scanned phased array of FIG. 9.

FIG. 11 is a partial illustration of a sectional view of the 2.4 GHz array 600 shown in FIGS. 9 and 10*a*. 10*b*, and 10*c*. Shown in this figure are the rear cover 614, the outer superstrate assembly 612, a linear actuator 616 that adjusts the position of the outer superstrate assembly 612, the fixed substrate 608 on which the transmission lines are disposed, the ground plane 606, the feed probes 604, the patch array 602, and the radome 622. The moveable superstrate assembly 612 is a low dielectric constant assembly, with printed trombone lines on its upper surface. It may be realized in a variety of ways, but one embodiment comprises a foam core 618 disposed between relatively thin but rigid printed circuit boards to create a flat and rigid structure. A lower layer of FR4 or other rigid printed circuit board material 615 disposed beneath the core 618 is used to stiffen the core 618 for contact with the springs 626. The linear actuator 616 may contact the outer superstrate assembly 612, the rigid printed circuit board material 615, or, as shown, the foam core 618. In other embodiments, the foam core 618 and rigid PCB 615 in FIG. 11 may be replaced with a more rugged plastic material such as ABS (a class of plastics based on acrylonitrile-bytadiene-styrene copolymers) or nylon.

Not shown in FIG. 11 is a second linear actuator that adjusts the position of the inner superstrate assembly 610. The second linear actuator may be formed, for example, by drilling a hole in the outer superstrate assembly 612 that is larger than the drive screw of the second linear actuator, and extends in the direction of movement of the inner and outer superstrate assemblies 610, 612. In this manner, the screw of the second linear actuator does not contact the outer superstrate assembly 612, and thus may independently actuate the inner superstrate assembly 610. The second linear actuator may be disposed on either the same side of the superstrate assembly 612 as the linear actuator 616 or on the opposite side of the superstrate assembly 612 as the linear actuator 616.

In yet another embodiment, the superstrate assembly may consist of only one etched printed circuit board (PCB), which is adhesively attached to a low dielectric insulating block that is threaded to interface with the linear actuator. This insulating block may have depressions on the side opposite to the PCB to accept one or more springs, such as leaf springs, spiral springs, or other types of springs.

This antenna cross section thus shows the basic mechanical features of the phased array 600 (not to scale). The trombone delay lines are comprised of printed conductive traces on the bottom of the substrate 608 and trombone lines on the top of the superstrate assembly 612. Teflon tape 624 may be used to promote capacitive coupling between microstrip line conductors (i.e. the transmission lines and the trombone lines), and to reduce friction during translation between the superstrate 613 and the substrate 608 and between the rear cover 614 and springs 626, that permit the superstrate assembly 610 to glide along the rear cover 614.

Figure 12:
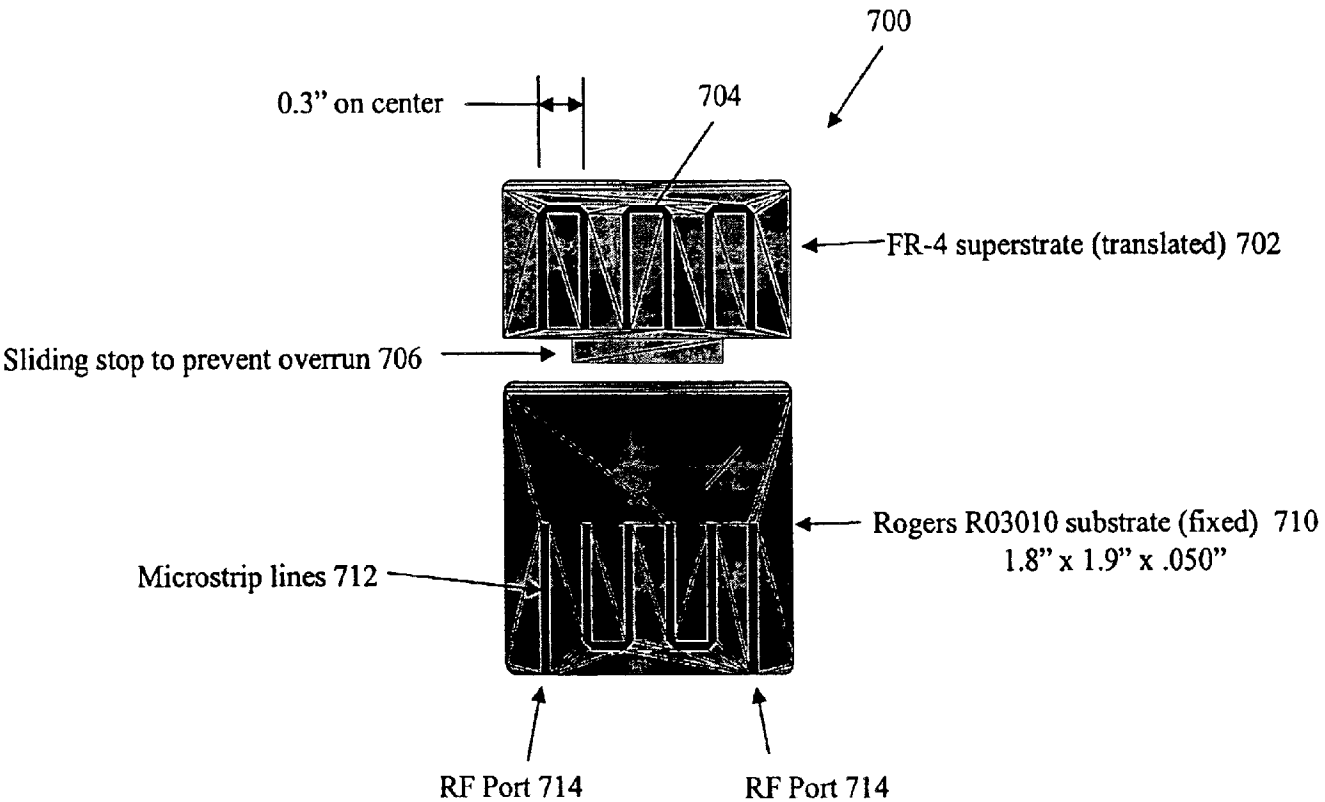
FIG. 12 shows a top view of another embodiment of a miniature variable delay line comprised of three cascaded microstrip trombone delay lines.

FIG. 12 shows a top view of the printed circuit artwork of another embodiment of a variable delay line 700 comprised of three cascaded trombone lines. The variable delay line 700 shows the moving superstrate 702 as an FR4 layer on which the trombone lines 704 are printed. As shown, the trombone lines 704 are isolated, i.e. they are conductive paths that are not electrically connected to each other on the moving superstrate 702 alone. As the moving superstrate 702 is a single part that moves and the trombone lines 704 are disposed on the moving superstrate 702, the trombone lines 704 are translatable in unison. The superstrate 702 is substantially rectangular, with a smaller rectangular extension as a sliding stop 706 to prevent overrun of the microstrip lines 712 printed on the fixed substrate 710. The fixed substrate 710 is formed from a substantially rectangular layer of Rogers R03010. The dielectric constant of the substrate, the translation distance of the trombone lines, and the number of cascaded trombone lines define the variation in insertion delay for variable delay line 700. The substrate 710 also has two RF feed ports 714 that provide an input and output for signals.

Figure 13:
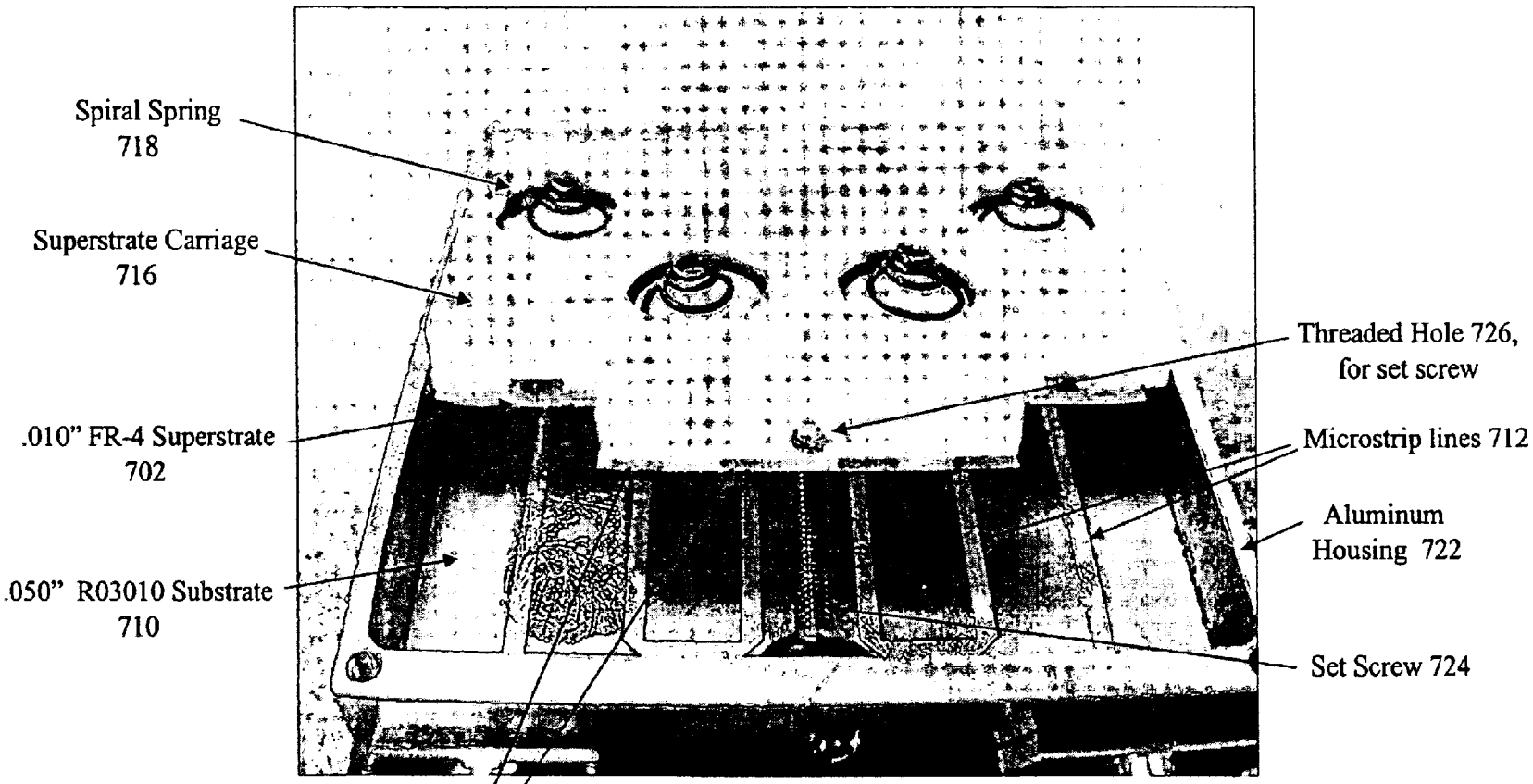
FIG. 13 shows a detailed view of the superstrate assembly of the embodiment of FIG. 12.

FIG. 13 shows a side view of the superstrate assembly that comprises the etched FR4 superstrate 702 and an attached sliding mechanism denoted as the superstrate carriage 716. The purpose of the superstrate carriage 716 is to offer a flat surface to attach the thin superstrate 702, to house the springs 718 which provide force to press the movable and fixed microstriplines together, and to engage the set screw 724 used for mechanical translation. For this prototype variable delay line, the superstrate carriage is 0.18" in total thickness and machined from ABS plastic. FIG. 13 also shows the superstrate assembly propped up so as to reveal an edge where the superstrate assembly slides over the fixed microstriplines 712. The design of the superstrate is intended to minimize the effective permittivity of the dielectric above the translated microstriplines 704, and hence minimize the impedance mismatch at the transitions defined by the edge of the superstrate. One feature is that the FR4 superstrate 702 is very thin, only 0.010" in nominal thickness. A second feature is that the superstrate carriage directly above the translated microstriplines has been milled to form a 0.030" deep rectangular cavity (air pocket) 720, which is more than 3 times the width of the microstripline 704.

Figure 14:
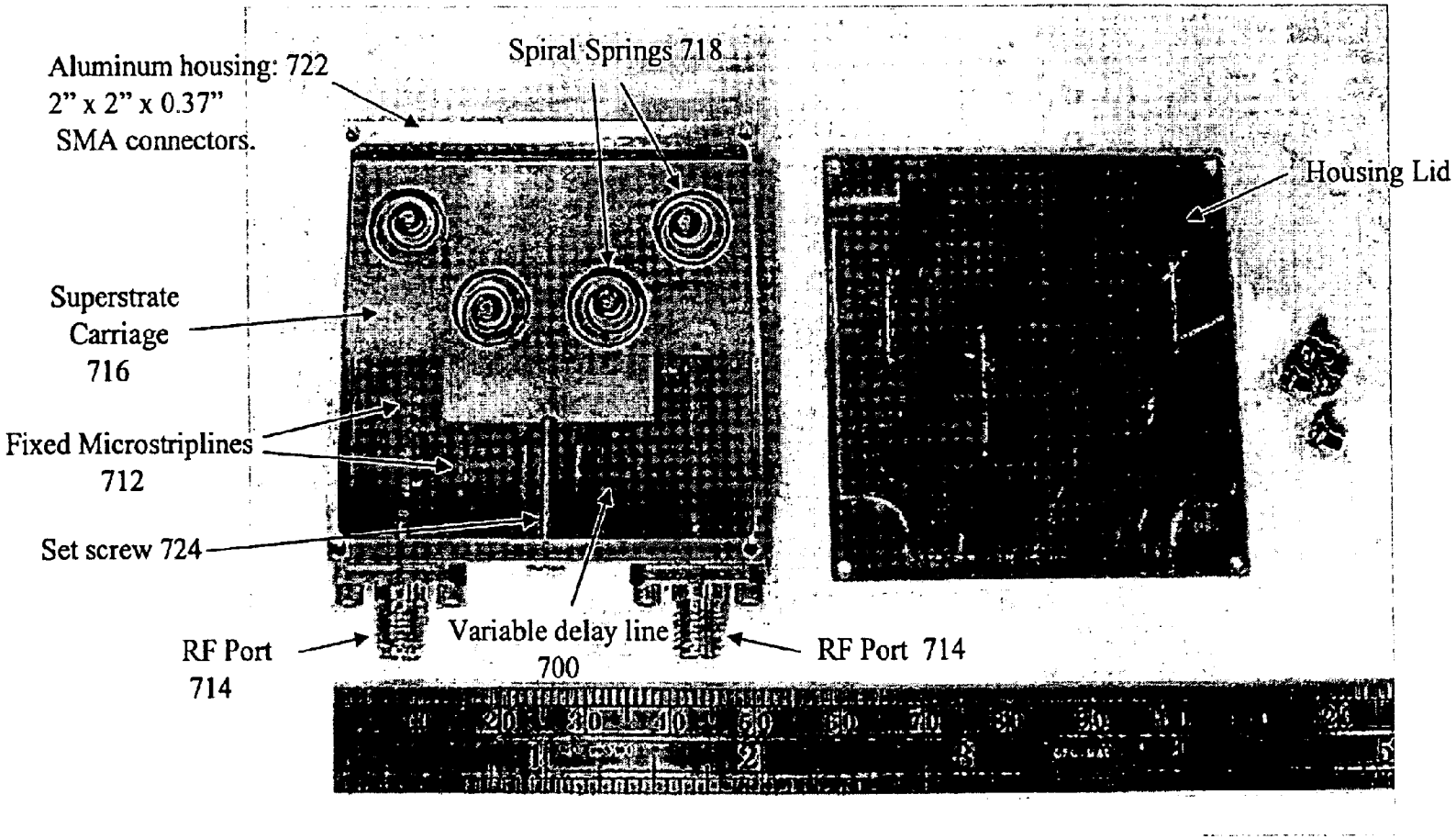
FIG. 14 shows a top view of the miniature VDL of the embodiment of FIGS. 12 and 13 with the trombone lines installed and the lid removed.

FIG. 14 shows a top view of the completed variable delay line 700 including the aluminum housing 722 with the trombone lines installed (and the lid removed). Many variations of this mechanical design are possible, without altering the electrical performance of the variable delay line. For instance, the housing 722 could be fabricated as a metal plated, injection molded, plastic component. The prototype design employs separate metal spiral springs 718. However, the superstrate carriage could be an injection molded plastic component with integrated cantilever springs that are all part of a single shot mold. The set screw 724 in this prototype is a 1" long 2-56 machine screw. However, it could be the shaft of a stepper motor so that the variable delay line has an adjustable delay whose delay is altered using electrical signals supplied to the stepper motor rather than being directly manually operated by the user.

Figure 16:
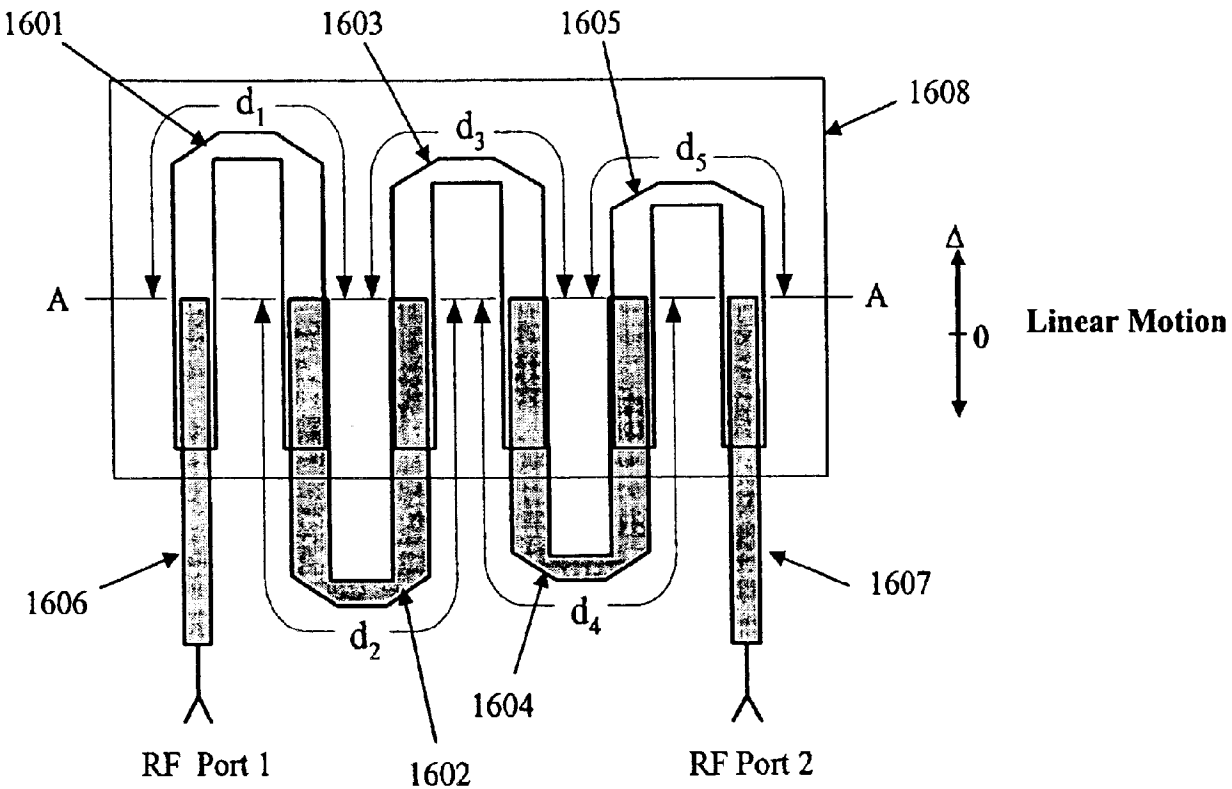
FIG. 16 shows a VDL with non-commensurate line lengths to improve return loss performance.

FIG. 16 illustrates some features of the mechanical layout of the microstriplines used in the prototype variable delay line of FIGS. 12, 13, and 14. There are three cascaded trombone lines, 1601, 1602, and 1603, printed on a common superstrate 1608. However, the physical length of these three microstriplines, $d_1$ (1601), $d_3$ (1603), and $d_5$ (1605), are intentionally not equal. The reason for this inequality is to avoid commensurate line lengths between discontinuities, which in turn, minimizes the impact of internal reflections and improves the return loss.

The discontinuities are primarily located at the junctions along line AA, which is the boundary between the movable and faxed microstriplines. These discontinuities are manifested by a change in the microstripline characteristic impedance, which is caused by an air gap below the translated microstriplines 1601, 1603, 1605, due to the finite thickness of the metal traces for the fixed microstriplines 1602, 1604, 1606, 1607. The fixed microstriplines 1602 and 1604 are designed to have different physical lengths $d_2$ and $d_4$ for similar reasons. Typical difference in length between adjacent trombone lines is 0.1".

Other problems may be solved by judicious design alterations. For example, a very thin (about 1 to 2 mils) dielectric layer between conductors on the fixed substrate (not shown) and the sliding superstrate 1608 may serve to minimize RF losses due to intermittent ohmic contact between sliding microstrip lines in a given trombone line by capacitively coupling the microstrip lines. In practice, this thin dielectric layer may even be a viscous fluid, such as a silicon or petroleum gel, to fill air gaps. However, the inclusion of this thin dielectric layer is not necessary to realize the variable delay line comprised of cascaded trombone lines.

Figure 17:
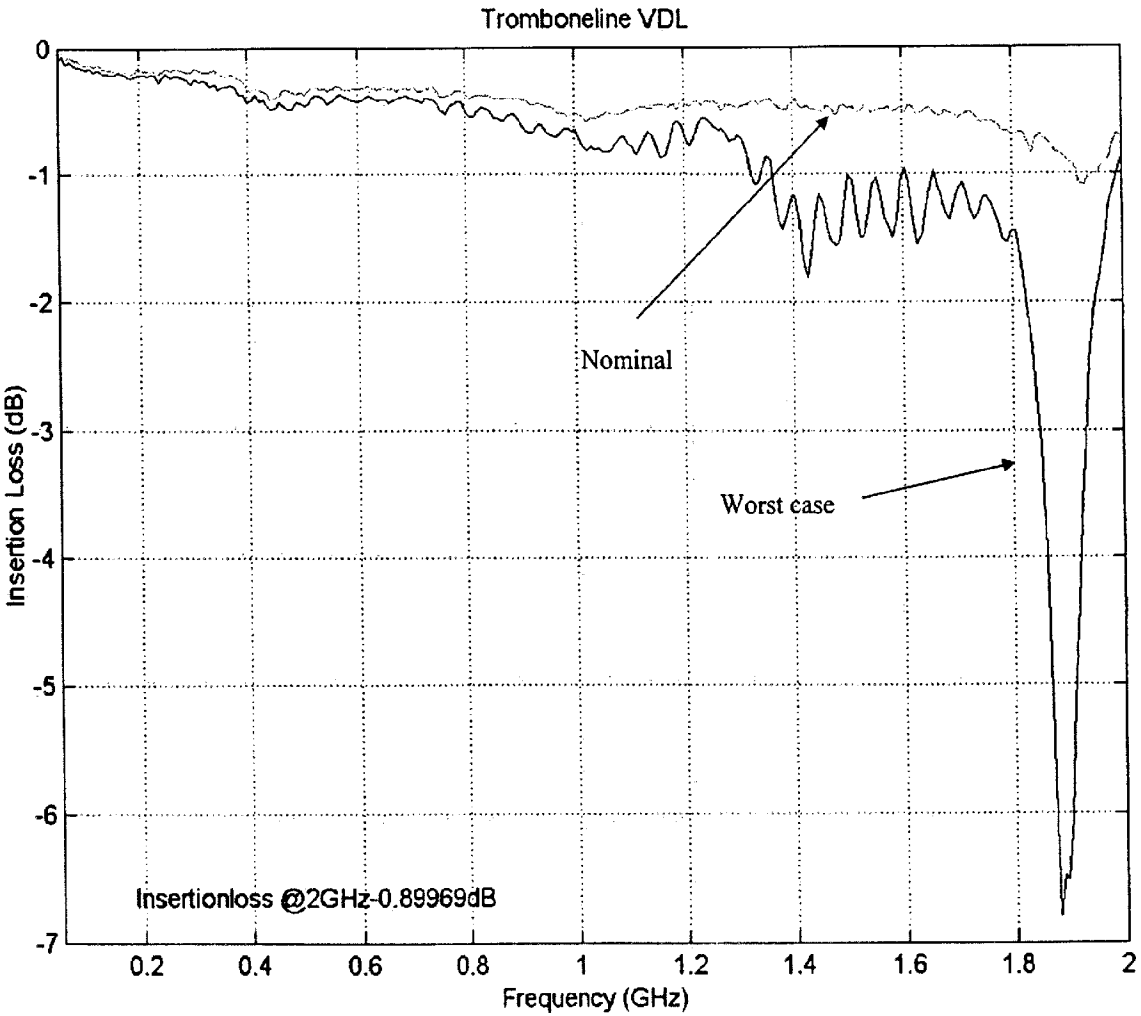
FIG. 17 shows a nominal and worst-case measure insertion loss for the miniature VDL of FIG. 14.
Figure 18:
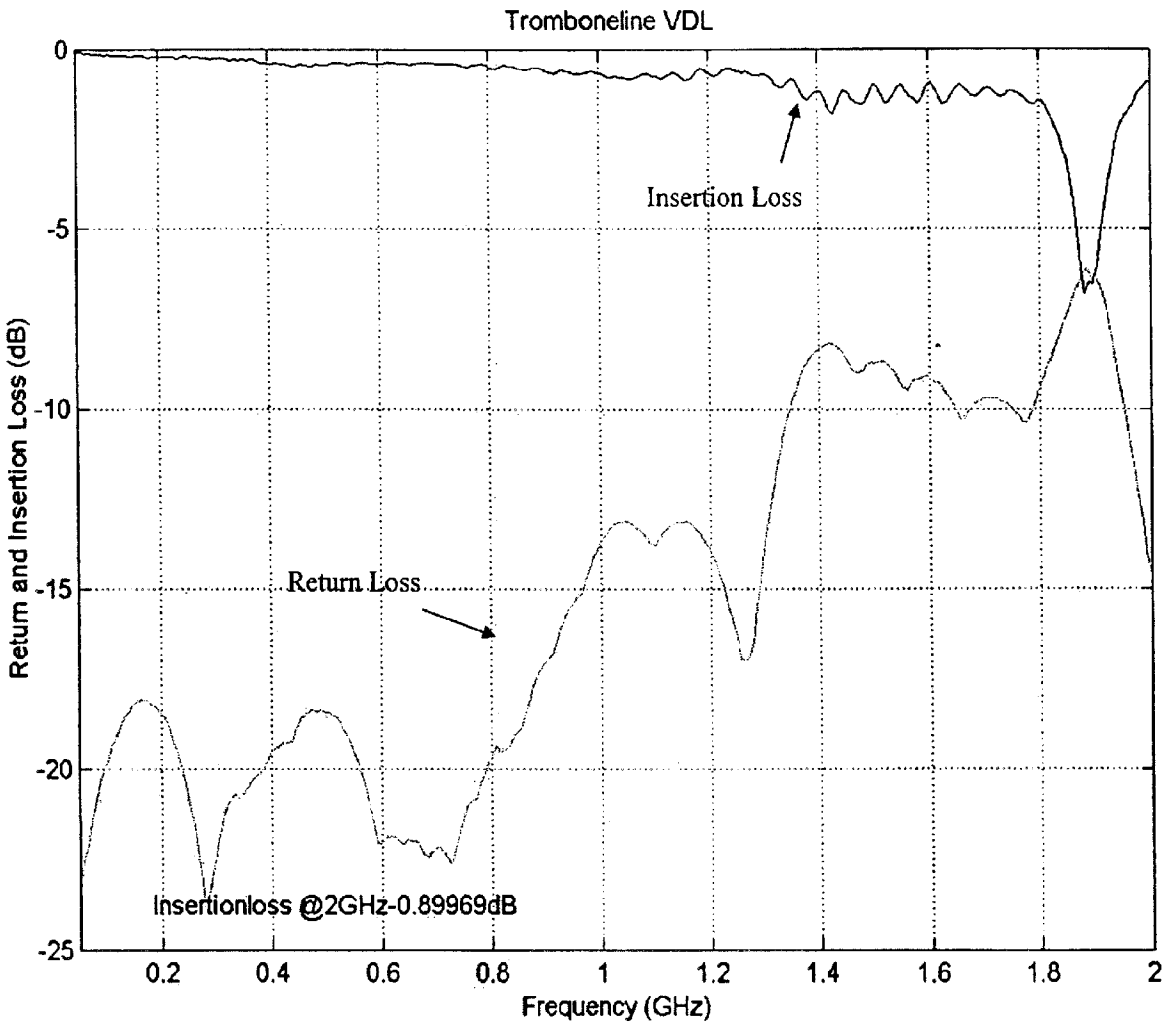
FIG. 18 shows the worst-case measured return loss for the miniature VDL of FIG. 14.

The prototype variable delay line shown in FIGS. 12, 13, and 14 exhibits a nominal insertion delay between 1.485 nanoseconds and 2.237 nanoseconds. Thus, the variation in insertion delay is greater than 0.75 nanoseconds, which equates to an air filled transmission line that is 8.85" long. This is remarkable considering the variable delay line footprint is only 2" square. Two curves for measured insertion loss are shown in FIG. 17. The nominal curve (moderate trombone line extension) shows less than 1 dB of loss below 2 GHz, while the worst case curve (maximum trombone line extension) reveals a parasitic resonance near 1.9 GHz, but has less than 1 dB of loss below 1.3 GHz. FIG. 18 shows the measured return loss at RF port 1 shown in FIG. 16. This is the worst-case return loss, which corresponds to maximum trombone line extension. Even so, it is better than −10 dB below 1.3 GHz, and better than −15 dB below 950 MHz.

Figure 19:
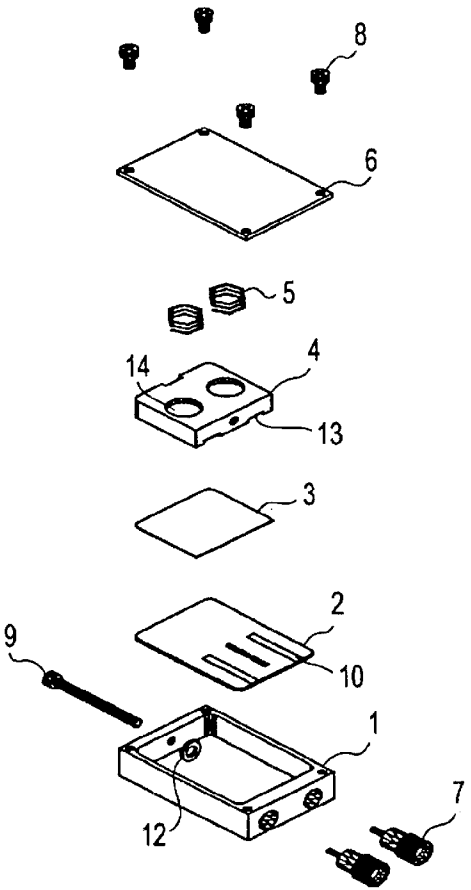
FIG. 19 is an exploded view of a miniature trombone line phase shifter.

One of the preferred embodiments of a trombone line variable delay line is shown in FIG. 19 and is similar to the embodiment shown in FIGS. 12–14. This miniature variable delay line is designed to be a phase shifter, with approximately 60° of phase shift at 1900 MHz. The amount of phase shift $\Delta\Phi$ is given by $$\Delta\phi = \frac{2\omega\Delta}{c}\sqrt{\varepsilon_{eff}}$$

where $\omega$ is the radian frequency, c is the speed of light, $\Delta$ is the translation distance of the trombone line, and $\epsilon_{eff}$ is the effective dielectric constant of the microstripline that comprises the trombone line.

FIG. 19 is an exploded view of a miniature trombone line phase shifter. The microstripline is printed on a fixed substrate 2. This substrate 2 is a 0.030" thick Rogers R03003 microwave laminate with ½ ounce copper. The substrate 2 is attached to the housing with conductive epoxy (not shown). The microstrip lines 10 are 0.075" wide for a 50 ohm characteristic impedance. The movable trombone line (not shown) consists of 0.075" wide traces printed on the lower side of the superstrate 3, which is a 0.010" thick FR4 printed circuit board. This superstrate 3 is adhesively attached, with acrylic pressure sensitive adhesive (not shown), to the machined nylon carriage 4.

The nylon carriage 4 has nominal dimensions of 0.194"×0.715"×0.866" and has a number of special features. One feature is at least one channel 13 positioned above the microstrip lines 10 on the superstrate 3. This channel 13 is a 0.030" deep by 0.175" wide air gap, which is devoid of solid dielectric and thus significant in maintaining a low effective dielectric constant for the carriage assembly of the carriage 4 and the superstrate 3. This insures a uniform characteristic impedance between the fixed and movable microstrip lines. The carriage 4 has two circular pockets 14 on the top side of its structure. The pockets 14 functions as a seat and secures two spiral springs 5 fabricated from music wire. The springs 5 are in compression and force the sliding carriage 4 and superstrate 3 against the fixed substrate 2. An additional feature of the carriage 4 is that it is drilled and tapped to accept a set screw 9. This set screw 9 is the mechanism for linear movement of the carriage 4 through a given distance $\Delta$. The maximum translation distance is approximately 0.50". Although the carriage 4 in the prototypes was a machined nylon component, it could also be injection molded from a variety of plastics.

Two different types of set screws 9 have been successfully used. One is a 2-56 by 1" nylon screw, and the second is a 2-56 by ¾" metal screw. A nylon screw has virtually no impact on the return loss of the trombone line, since it creates no transmission line discontinuity. However, if a metal screw is used for phase adjustment, then the centerline of the screw should be at least 0. 150" above the top of the substrate 2. A thrust washer 12 is used to capture the set screw 9 such that it cannot be unscrewed from the housing, and thus it forces the carriage 4 to translate when the set screw 9 is rotated counterclockwise.

The prototype housing 1 is machined from aluminum and has exterior dimensions of 0.980"×1.45"×0.360" including the cover 6. Conventional screws 8 are used to attach the cover 6 to the housing 1. Other approaches for fabricating the housing 1 include a cast aluminum part, and an injection molded plastic housing, which is metalized on interior and exterior surfaces. Press fit SMA connectors 7 are used in the prototype miniature variable delay line to avoid the size and weight of mounting flanges. However, almost any small 50Ω RF connector will work. The total weight of this miniature variable delay line is about 1 ounce.

Figure 20A:
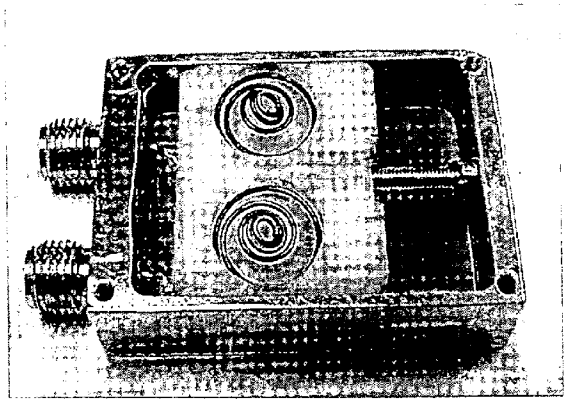
FIGS. 20*a* and 20*b* show a miniature VDL with its cover removed.
Figure 20B:
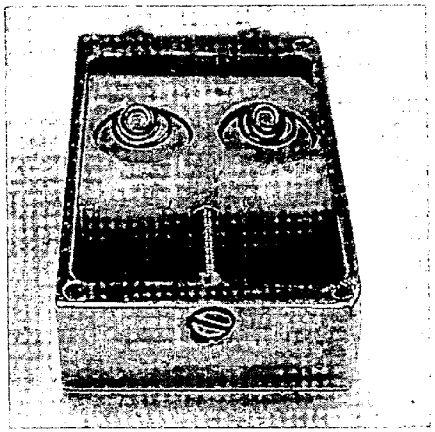

Photos of the preferred embodiment are shown below in FIGS. 20*a* and 20*b*. FIGS. 20*a* and 20*b* show a miniature variable delay line with its cover removed to reveal the carnage 4, springs 5, and set screw 9. The carriage position shown is for minimum insertion delay. The housing is 1.45" in length, not including the SMA connectors.

Figure 21:
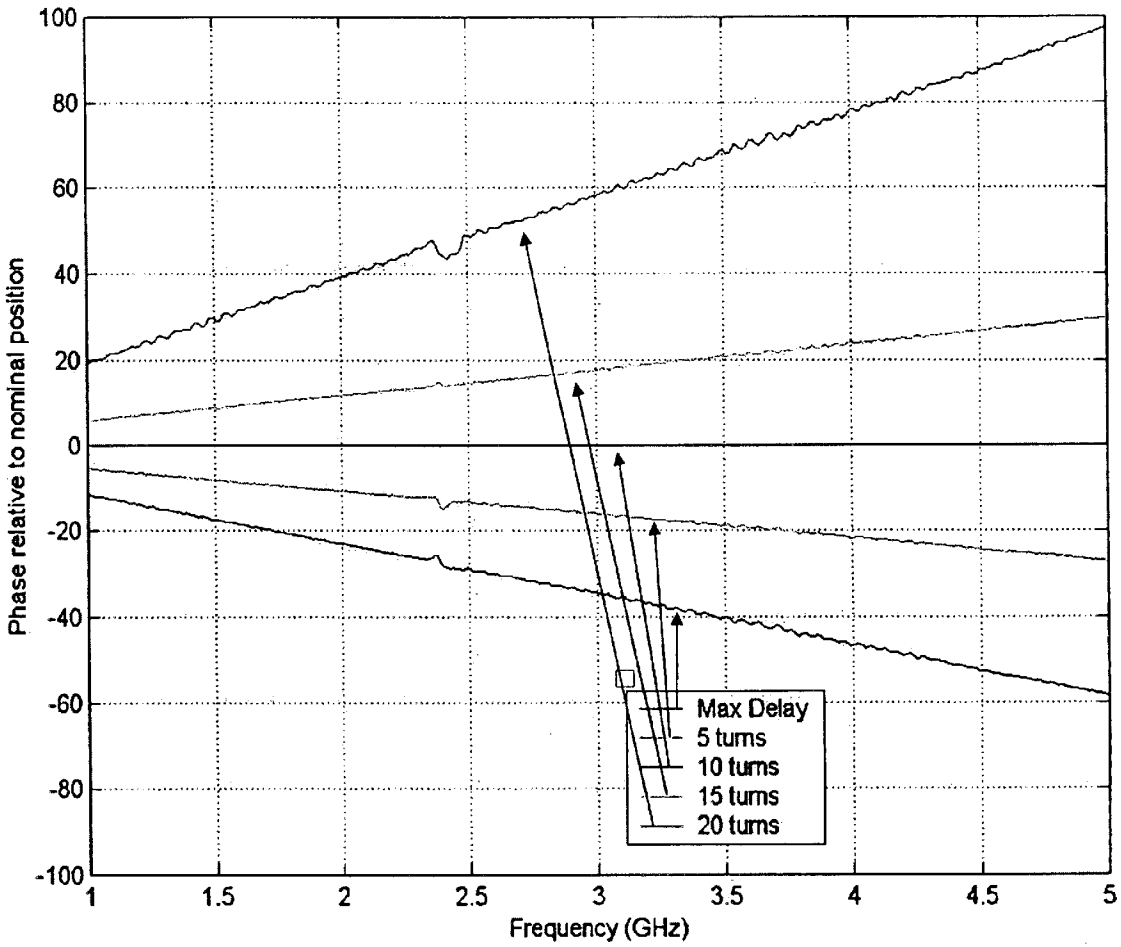
FIG. 21 is the measured phase response of the miniature trombone line VDL shown in FIGS. 19–20.

The phase response over 1 GHz to 5 GHz is shown in FIG. 21 for a variety of carriage positions. The phase curves were normalized for the carriage position corresponding to 10 screw turns from the maximum delay response. Normalization was accomplished by subtracting the phase response associated with the 10-turn position. Note the extremely good phase linearity over the entire 5:1 frequency range. A slight phase aberration occurs near 2.4 GHz due to resonance of the metal screw. The nominal insertion loss for the trombone line variable delay line shown in FIGS. 20*a* and 20*b* is better than 0.1 dB from DC to at least 2 GHz, and better than 0.25 dB up to 5 GHz. The return loss of the variable delay line is nominally better than −30 dB in the PCS band (1850–1990 MHz) for all carriage positions. Return loss is better than −18 dB up to 5 GHz for all carriage positions. Temperature testing indicates this miniature variable delay line design is quite stable, with less than 1.5° of phase shift over the temperature range of −35° C. to +85° C.

Regarding beamformers, impedance transformers may be incorporated into the trombone lines for 2:1 impedance transformations to obtain good input return loss for all beam scan positions. The beamformer insertion loss may be minimized by avoiding very narrow microstrip line widths, choosing a relatively low characteristic impedance internal to the feed network, and optimizing the trade off between translational displacement and substrate permittivity. Crosstalk between adjacent trombone lines may be avoided by observing conventional microstrip routing rules and avoiding thick substrates. The transmission line lengths and widths for beam scan and insertion loss may be optimized by employing a circuit simulator (such as the Eagleware circuit simulator) to model and tune the physical microstrip lines and minimize input return loss, minimize insertion loss, and maximize beam scan.

Thus, advantages of microstrip trombone delay lines for antenna beamformers include:

(1) an approximately linear scan angle response—for small scan angles, the arcsine function may be approximated by its argument;

(2) a low mismatch loss—if properly designed, no significant characteristic impedance changes are realized when trombone lines are adjusted;

(3) low RF insertion losses for high power applications (for example, the simple prototype delay line of FIG. 2 had approximately 0.8 dB of insertion loss at L band frequencies and used four cascaded trombone lines, while the 16-element array uses 6 cascaded trombone lines between the RF input port and any given element. This implies an insertion loss of about 1.2 dB at L-band frequencies for a two dimensional scanned array);

(4) simple mechanics as only two moving parts (the superstrates) are needed for two dimensional scanning;

(5) low manufacturing cost as (a) only conventional printed circuit board fabrication is required, (b) no tight manufacturing tolerances are necessary, (c) only conventional substrate materials are required, and (d) no RF electronics are necessary;

(6) repeatable scan performance as no hysteresis effects are anticipated if good quality linear actuators and proper spring designs are employed;

(7) minimal sensitivity to vibration—springs can be used to force the substrate and superstrate together for a snug fit, and (8) low passive inter-modulation products—metal to metal contact may be avoided with the use of a thin dielectric layer between fixed and sliding microstrip lines, so galvanic reactions between dissimilar metals may be eliminated. Although the thin dielectric layer between substrate and superstrate is not necessary for this invention, this feature may be useful for high power applications.

Further advances may increase the scanning speed as other linear actuators may be used rather than using set screws.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. A true time delay phase shifter comprising:

a fixed medium having a first conductive path along which electromagnetic signals propagate; and a movable medium having a second conductive path in a shape of a trombone line along which the signals propagate, the movable medium translatable such that the second conductive path overlaps the first conductive path by a variable amount, the movable medium containing a sliding stop to prevent overrun of the first conductive oath by the second conductive path;

wherein the first and second conductive paths are printed conductive traces, a time delay of the signals propagating along each conductive path is dependent on the overlap between the first and second conductive paths.

2. The phase shifter of claim 1, wherein the printed traces are microstriplines.

3. The phase shifter of claim 1, wherein a thin dielectric layer is disposed between the fixed and movable media.

4. The phase shifter of claim 3, wherein a per unit length parallel plate capacitance that occurs due to the overlap between the first and second conductive paths dominates a fixed capacitance per unit length between the printed trace and ground in the first and second conductive paths.

5. The phase shifter of claim 1, wherein a plurality of trombone lines are cascaded to achieve a greater change in insertion delay than obtainable with a single trombone line.

6. The phase shifter of claim 5, wherein the plurality of trombone lines have non-commensurate line lengths.

7. The phase shifter of claim 1, wherein the first and second conductive paths continuously variably overlap.

8. The phase shifter of claim 1, wherein the movable medium is linearly translatable.

9. The phase shifter of claim 1, wherein the first conductive path comprises a U-shaped path.

10. The phase shifter of claim 1, wherein the second conductive path comprises a U-shaped path.

11. The phase shifter of claim 1, wherein the first conductive path comprises a plurality of parallel paths.

12. The phase shifter of claim 1, wherein the first conductive path comprises at least four sections, each section having a different width.

13. The phase shifter of claim 12, wherein pairs of the sections are symmetric around a center line have the same length.

14. The phase shifter of claim 13, wherein the second conductive path comprises sections having the same length, are symmetric around the center line, and overlapping one pair of at least the four sections of the first conductive path.

15. The phase shifter of claim 14, wherein the lengths and widths of the sections of the first and second conductive paths are selected to impedance match between ends of the first conductive paths.

16. The phase shifter of claim 1, wherein no direct or ohmic contact exists between the first and second conductive paths.

17. The phase shifter of claim 1, wherein an impedance transformer is incorporated into the first and second conductive paths.

18. The phase shifter of claim 1, further comprising a mechanical actuator that provides linear translation to the movable medium.

19. The phase shifter of claim 1, wherein the movable medium has an effective permittivity much lower than an effective permittivity of the fixed medium.

20. The phase shifter of claim 19, wherein the movable medium has at least one cavity that reduces the effective permittivity of the movable medium.

21. A beamformer comprising the phase shifter of claim 20.

22. The phase shifter of claim 19, wherein the movable medium has at least one pocket disposed therein, wherein the pocket secures at least one spring that forces the moveable and fixed mediums together.

23. A beamformer comprising the phase shifter of claim 22.

24. The phase shifter of claim 19, wherein the movable medium contains at least two isolated conductive paths, which comprise multiple cascaded trombone lines, and which are printed on a common superstrate so as to be translatable in unison.

25. The phase shifter of claim 19, wherein the movable medium has at least one channel devoid of solid dielectric, wherein the channel essentially follows and is located above the conductive traces of the moveable medium.

26. A beamformer comprising the phase shifter of claim 25.

27. A beamformer comprising a planar, fractal architecture, wherein a plurality of phase shifters of claim 1 are integrated into fractal branches of a feed network.

28. The beamformer of claim 27, wherein at least two of the second conductive paths which comprise the phase shifters are printed on a common superstrate such that the at least two of the second conductive paths are actuated in unison.

29. A beamformer comprising the phase shifter of claim 1.

30. The beamformer of claim 29, wherein two independently translatable superstrates are translated in a same vector direction to permit beam scanning in two orthogonal principal planes.

31. The beamformer of claim 29, further comprising an actuator that provides linear translation to the movable medium.

32. The beamformer of claim 31, wherein the actuator is a mechanical actuator.

33. The beamformer of claim 29, wherein only a single actuator is required for scanning a beam from the beamformer in one principal plane direction.

34. The beamformer of claim 29, wherein only two actuators are required for scanning a beam from the beamformer in two principal plane directions.

35. The beamformer of claim 29, wherein two independently translatable superstrates are employed for beam scanning in two different principal planes.

36. The beamformer of claim 29, wherein the beamformer has an approximately linear scan angle response for small displacements of the moveable medium.

37. The beamformer of claim 36, wherein for small scan angles, the scan angle is:

$$\theta = \arcsin\left(\frac{4\Delta}{d}\sqrt{\varepsilon_{eff}}\right)$$

where $\Delta$ is a physical displacement of the second conductive path,d is an inter-element spacing between antenna elements of the beamformer, $\epsilon_{eff}$ is an effective dielectric constant of a feed network of the beamformer.

38. A beamformer comprising a planar, fractal architecture having a plurality of phase shifters integrated into fractal branches of a feed network, each phase shifter comprising:

a fixed medium having a first conductive path along which electromagnetic signals propagate; and a movable medium having a second conductive path in a shape of a trombone line along which the signals propagate, the movable medium translatable such that the second conductive path overlaps the first conductive path by a variable amount;

wherein the first and second conductive paths are printed conductive traces, and a time delay of the signals propagating along each conductive path is dependent on the overlap between the first and second conductive paths, and at least two of the second conductive paths are printed on a common superstrate such that the at least two of the second conductive paths are actuated in unison.

39. A true time delay phase shifter comprising:

a fixed substrate having a first printed trace;

at least one movable superstrate having second printed trace, the at least one superstrate linearly translatable such that the second printed trace overlaps the first printed trace by a variable amount, the superstrate containing a sliding stop to prevent overrun of the first conductive oath by the second conductive path; and wherein a time delay of signals propagating along the traces is dependent on the overlap between the first and second traces.

40. The phase shifter of claim 39, wherein no direct or ohmic contact exists between the first and second printed traces.

41. The phase shifter of claim 40, wherein the first and second printed traces comprise a trombone delay line.

42. The phase shifter of claim 41, wherein the second printed trace comprises a U-shaped portion of the trombone delay line.

43. The phase shifter of claim 41, wherein the first conductive path comprises a plurality of parallel paths of the trombone delay line.

44. The phase shifter of claim 41, wherein a plurality of trombone lines are cascaded for additional phase shift per unit of translation distance.

45. The phase shifter of claim 44, wherein the trombone lines have non-commensurate line lengths.

46. The phase shifter of claim 39, wherein the first printed trace comprises four sections, each section having a different width.

47. The phase shifter of claim 46, wherein pairs of the sections are symmetric around a center line have the same length.

48. The phase shifter of claim 47, wherein the second printed trace comprises sections having the same length, are symmetric around the center line, and overlapping one pair of the four sections.

49. The phase shifter of claim 48, wherein the lengths and widths of the sections of the first and second printed traces are selected to impedance match between ends of the first printed traces.

50. The phase shifter of claim 39, wherein an impedance transformer is incorporated into the first and second printed traces.

51. The phase shifter of claim 39, wherein a per unit length parallel plate capacitance that occurs due to the overlap between the first and second printed traces dominates a fixed capacitance per unit length to ground in the first and second printed traces.

52. The phase shifter of claim 39, further comprising a mechanical actuator that provides linear translation to the superstrate.

53. The phase shifter of claim 39, wherein the superstrate has a permittivity much lower than that of the substrate.

54. A beamformer comprising the phase shifter of claim 39.

55. The beamformer of claim 54, further comprising an actuator that provides linear translation to the superstrate.

56. The beamformer of claim 55, wherein the actuator is a mechanical actuator.

57. The beamformer of claim 54, wherein the beamformer has an approximately linear scan angle response for small displacements of the moveable superstrate.

58. The beamformer of claim 57, wherein for small scan angles, the scan angle is:

$$\theta = \arcsin\left(\frac{4\Delta}{d}\sqrt{\varepsilon_{eff}}\right)$$

where $\Delta$ is a physical displacement of the second printed trace,d is an inter-element spacing between antenna elements of the beamformer, and $\epsilon_{eff}$ is an effective dielectric constant of a feed network of the beamformer.

59. The beamformer of claim 54, wherein the at least one superstrate of the beamformer comprises two movable superstrates, each movable superstrate independently actuated by a single actuator such that only two actuators are required for scanning a beam from the beamformer in two principal plane directions.

60. The beamformer of claim 59, wherein each movable superstrate contains a plurality of isolated second printed trace, each second printed trace comprising a U-shaped portion of a trombone delay line.

61. The beamformer of claim 54, wherein only a single actuator is required for scanning a beam from the beamformer in one principal plane direction.

62. The beamformer of claim 54, wherein only two actuators are required for scanning a beam from the beamformer in two principal plane directions.

63. A true time delay phase shifter comprising:

a fixed medium having a first conductive path along which electromagnetic signals propagate; and a movable medium having a second conductive path in a shape of a trombone line along which the signals propagate, the movable medium translatable such that the second conductive path overlaps the first conductive path by a variable amount and having an effective permittivity much lower than an effective permittivity of the fixed medium;

wherein the first and second conductive paths are printed conductive traces, and a time delay of the signals propagating along each conductive path is dependent on the overlap between the first and second conductive paths.

64. The phase shifter of claim 63, wherein the movable medium has at least one channel devoid of solid dielectric, wherein the channel essentially follows and is located above the conductive traces of the moveable medium.

65. The phase shifter of claim 63, wherein the movable medium has at least one pocket disposed therein, wherein the pocket secures at least one spring that forces the moveable and fixed mediums together.

66. The phase shifter of claim 63, wherein the movable medium contains at least two isolated conductive paths, which comprise multiple cascaded trombone lines, and which are printed on a common superstrate so as to be translatable in unison.

67. The phase shifter of claim 63, wherein the movable medium has at least one cavity that reduces the effective permittivity of the movable medium.

68. A true time delay phase shifter comprising:

a fixed medium having a first conductive path along which electromagnetic signals propagate, the first conductive path having a plurality of sections of different widths; and a movable medium having a second conductive path in a shape of a trombone line along which the signals propagate, the movable medium translatable such that the second conductive path overlaps the first conductive path by a variable amount;

wherein the first and second conductive paths are printed conductive traces, and a time delay of the signals propagating along each conductive path is dependent on the overlap between the first and second conductive paths.

69. The phase shifter of claim 68, wherein pairs of the sections are symmetric around a center line have the same length.

70. The phase shifter of claim 69, wherein the second conductive path comprises sections having the same length, are symmetric around the center line, and overlapping one pair of plurality of the sections of the first conductive path.

71. The phase shifter of claim 70, wherein lengths and widths of the sections of the first and second conductive paths are selected to impedance match between ends of the first conductive paths.

72. A true time delay phase shifter comprising:

a fixed medium having first conductive paths along which electromagnetic signals propagate, at least one of the first conductive paths having a line length different from at least one other first conductive path; and a movable medium having second conductive paths each in a shape of a trombone line along which the signals propagate, at least one of the second conductive paths having a line length different from at least one other second conductive path, the movable medium translatable such that the second conductive paths overlap the first conductive paths by a variable amount;

wherein the first and second conductive paths are printed conductive traces, and a time delay of the signals propagating along each conductive path is dependent on the overlap between the first and second conductive paths.

73. The phase shifter of claim 72, wherein none of the line lengths of the first conductive paths are equal and none of the line lengths of the second conductive paths are equal.

74. The phase shifter of claim 73, wherein none of the line lengths of the first and second conductive paths are equal.

* * * * *